US008027624B2

(12) United States Patent
Yamada et al.

(10) Patent No.: US 8,027,624 B2
(45) Date of Patent: Sep. 27, 2011

(54) DEVELOPER APPARATUS, AN IMAGE FORMING APPARATUS AND AN IMAGE FORMING METHOD

(75) Inventors: Yoichi Yamada, Shiojiri (JP); Masahiro Maeda, Shiojiri (JP); Takatomo Fukumoto, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 338 days.

(21) Appl. No.: 12/327,677

(22) Filed: Dec. 3, 2008

(65) Prior Publication Data

US 2009/0148197 A1 Jun. 11, 2009

(30) Foreign Application Priority Data

Dec. 5, 2007 (JP) ..... 2007-314663

(51) Int. Cl.
*G03G 15/09* (2006.01)

(52) U.S. Cl. ..... 399/284; 399/286

(58) Field of Classification Search ..... 399/281, 399/284, 286

See application file for complete search history.

(56) References Cited

U.S. PATENT DOCUMENTS

| | | | | |
|---|---|---|---|---|
| 7,599,650 | B2 | 10/2009 | Katoh et al. | |
| 2005/0276633 | A1* | 12/2005 | Ueda et al. | 399/159 |
| 2007/0110481 | A1 | 5/2007 | Yamada et al. | |
| 2007/0206240 | A1* | 9/2007 | Koike et al. | 358/498 |
| 2007/0212088 | A1 | 9/2007 | Koike et al. | |

FOREIGN PATENT DOCUMENTS

| | | | |
|---|---|---|---|
| JP | 63199382 | A | 8/1988 |
| JP | 2003-316146 | | 11/2003 |
| JP | 2006139075 | A | 6/2006 |
| JP | 2007-121949 | | 5/2007 |
| JP | 2007127907 | A | 5/2007 |
| JP | 2007-140080 | | 6/2007 |
| JP | 2007199423 | A | 8/2007 |
| JP | 2007199424 | A | 8/2007 |
| JP | 2007233195 | A | 9/2007 |

OTHER PUBLICATIONS

European search report for corresponding European application 08020976.0 lists the references above.

* cited by examiner

*Primary Examiner* — David Gray
*Assistant Examiner* — Barnabas Fekete
(74) *Attorney, Agent, or Firm* — DLA Piper LLP (US)

(57) ABSTRACT

A developer apparatus includes a toner carrier roller with plural rows of convex sections arranged in width and circumferential directions of the roller. Top surfaces of the convex sections coincide with a curved surface of a single cylinder shaped like the roller. Convex section extending surfaces obtained by extending the top surfaces of the convex sections in the width direction overlap between convex sections belong to the same row and do not overlap between convex sections belonging to different rows. A width in the circumferential direction of a restriction nip formed by contact of an elastic abutting member of a restriction member with the roller is smaller than a spacing between two convex sections belonging to convex section rows that are adjacent in the circumferential direction.

12 Claims, 15 Drawing Sheets

COMPARATIVE EXAMPLE

DEVELOPER APPARATUS, AN IMAGE FORMING APPARATUS AND AN IMAGE FORMING METHOD

CROSS REFERENCE TO RELATED APPLICATION

The disclosure of Japanese Patent Application No. 2007-314663 filed on Dec. 5, 2007 including specification, drawings and claims is incorporated herein by reference in its entirety.

BACKGROUND

1. Technical Field

The present invention relates to a developer apparatus which comprises a toner carrier roller whose surface carries toner, and an image forming apparatus for and an image forming method of developing an electrostatic latent image with toner using this roller.

2. Related Art

In techniques for developing an electrostatic latent image carried on an image carrier with toner, an apparatus is widely used which includes a toner carrier roller which is shaped approximately like a cylinder, carries toner on a surface thereof, and is arranged opposed facing the image carrier. For the purpose of improving the characteristics of toner carried on the surface of such a toner carrier roller, the applicant of the present application has earlier disclosed a structure of a toner carrier roller having a cylindrical shape that the surface of the roller includes convex sections which are regularly arranged and a concave section which surrounds the convex sections (JP-A-2007-121949). Since the concavo-convex patterns in the surface are regulated and uniform, such a structure is advantageous in that it permits easy control of the thickness of a toner layer which is carried on the surface of the roller, the charge level and the like.

In an image forming apparatus having the structure above, for the purpose of restricting the thickness of a toner layer carried by the convex and the concave sections formed in the toner carrier roller to a predetermined thickness, a layer thickness restriction member (restriction blade) abuts on the toner layer which is on the surface of the toner carrier roller.

SUMMARY

However, in the case where a toner carrier roller having the structure above is used, owing to the evenness of the convexo-concave, scattering of toner from the surface of the toner carrier roller, fog and the like will be a problem unless a toner layer thickness on the toner carrier roller is strictly controlled. Particularly when toner becomes compressed powder due to the pressing force from the restriction blade, the toner gathers together as large aggregations or clusters of an additive, wax and the like falling off from the toner serve as cores around which even larger toner aggregations are created. They may leak out to outside a developer and get scattered or may adhere to an image carried on the image carrier and cause fog. Further, toner aggregations thus created may fixedly adhere to the toner carrier roller, thereby resulting in filming, image defects, etc.

An advantage of some aspects of the invention is to provide technology for preventing problems such as leakage and scattering of toner and fog attributable to creation of toner aggregations in a developer apparatus, an image forming apparatus and an image forming method which use a toner carrier roller whose surface is provided with convexoconcave.

According to a first aspect of the invention, there is provided a developer apparatus, comprising: a toner carrier roller that is shaped approximately like a cylinder, rotates while carrying a toner layer of charged toner on a surface thereof, and is provided, on the surface thereof, with plural convex section rows, each of which has plural convex sections arranged in a row in a width direction parallel to a rotational axis of the toner carrier roller and which are arranged in a circumferential direction orthogonal to the width direction and parallel to a circumferential surface of the toner carrier roller, the convex sections being so constructed and arranged that top surfaces of the convex sections coincide with a part of a curved surface of a single cylinder; and a restriction member that abuts on the surface of the toner carrier roller to restrict the toner layer carried on the surface of the toner carrier roller, includes an elastic abutting member which is made of an elastic material and has an edge part which extends in the width direction, the edge part being pressed into contact with the surface of the toner carrier roller, wherein a virtual surface which is obtained by extending the top surface of each convex section in the width direction and forms a part of the curved surface of the single cylinder is defined as a convex section extending surface of each convex section, and the convex section extending surfaces overlap each other between the convex sections belonging to the same convex section row, whereas the convex section extending surfaces do not overlap each other between the convex sections belonging to mutually different convex section rows.

In the first aspect of the invention constructed as above, by bringing the edge part of the elastic abutting member into contact with the convex sections of the toner carrier roller, the toner is carried in an area (hereinafter, referred to as a "concave section") which is located between the convex sections and at a shorter distance to the rotational axis of the toner carrier roller than the convex sections and surrounds the convex sections, whereas no toner is carried on the convex sections. Since the toner is not pressed by the restriction member on the convex sections in this way, the formation of toner aggregates resulting from the pressing of the restriction member can be suppressed.

The elastic abutting member of the restriction member is elastically deformed by being pressed into contact with the convex sections of the toner carrier roller. On the other hand, since the surface of the toner carrier roller is recessed from the convex sections between one convex section row and the convex section row adjacent thereto, a pressure exerted to the edge part of the elastic abutting member is reduced to decrease a deformation amount caused by elastic deformation. In other words, the elastic abutting member cyclically repeats elastic deformation and relaxation caused by pressure contact when the convex section rows that come into contact with the elastic abutting member are successively switched as the toner carrier roller is rotated. Thus, the edge part of the elastic abutting member comes to project toward the bottoms of the concave sections. The edge part projecting toward the bottom of the concave section in this way acts to hit the toner carried in the concave section.

Mere application of pressing force upon toner carried by the concave sections could flocculate toner or press toner against and fixedly adhere toner to the surface of the toner carrier roller. However, the edge part vibrates to alternately apply and mitigate pressing force upon the concave section according to the above structure. Hence, it is possible to crush toner aggregations which are at or around the concave section. This was confirmed through experiments as described later. According to the invention, destruction of toner aggregations at an early stage makes it possible to prevent growth of larger toner aggregations and hence associated leakage, scattering, fog, filming, etc. In addition, stimulation of toner at or near the concave section attains an effect of increasing the fluidity of the toner and improving the uniformity of a toner layer.

According to a second aspect of the invention, there is provided an image forming apparatus, comprising: an image carrier that carries an electrostatic latent image; a toner carrier roller that is shaped approximately like a cylinder, is arranged opposed to the image carrier, rotates while carrying a toner layer of charged toner on a surface thereof, and is provided, on the surface thereof, with plural convex section rows, each of which has plural convex sections arranged in a row in a width direction parallel to a rotational axis of the toner carrier roller and which are arranged in a circumferential direction orthogonal to the width direction and parallel to a circumferential surface of the toner carrier roller, the convex sections being so constructed and arranged that top surfaces of the convex sections coincide with a part of a curved surface of a single cylinder; and a restriction member that abuts on the surface of the toner carrier roller to restrict the toner layer carried on the surface of the toner carrier roller, includes an elastic abutting member which is made of an elastic material and has an edge part which extends in the width direction, the edge part being pressed into contact with the surface of the toner carrier roller, wherein a virtual surface which is obtained by extending the top surface of each convex section in the width direction and forms a part of the curved surface of the single cylinder is defined as a convex section extending surface of each convex section, and the convex section extending surfaces overlap each other between the convex sections belonging to the same convex section row, whereas the convex section extending surfaces do not overlap each other between the convex sections belonging to mutually different convex section rows.

According to a third aspect of the invention, there is provided an image forming method, comprising: preparing a toner carrier roller that is shaped approximately like a cylinder, rotates while carrying a toner layer of charged toner on a surface thereof and is provided, on the surface thereof with plural convex section rows, each of which has plural convex sections arranged in a row in a width direction parallel to a rotational axis of the toner carrier roller and which are arranged in a circumferential direction orthogonal to the width direction and parallel to a circumferential surface of the toner carrier roller, the convex sections being so constructed and arranged that top surfaces of the convex sections coincide with a part of a curved surface of a single cylinder, a virtual surface which is obtained by extending the top surface of each convex section in the width direction and forms a part of the curved surface of the single cylinder being defined as a convex section extending surface of each convex section, the convex section extending surfaces overlapping each other between the convex sections belonging to the same convex section row, whereas the convex section extending surfaces not overlapping each other between the convex sections belonging to mutually different convex section rows; preparing a restriction member that includes an elastic abutting member which is made of an elastic material and has an edge part which extends in the width direction; arranging the toner carrier roller opposed to an image carrier which carries an electrostatic latent image; and developing the electrostatic latent image carried by the image carrier with toner while restricting an amount of toner carried by the toner carrier roller by pressing the edge part into contact with the surface of the toner carrier roller.

In these aspects of the invention, similar to the above first aspect of the invention relating to the developer apparatus, the formation of toner aggregates can be suppressed and the formed toner aggregates can be crushed by vibrating the edge part of the elastic abutting member, wherefore the occurrence of problems such as leakage, scattering and fog resulting from the growth of the toner aggregates can be prevented.

The above and further objects and novel features of the invention will more fully appear from the following detailed description when the same is read in connection with the accompanying drawing. It is to be expressly understood, however, that the drawing is for purpose of illustration only and is not intended as a definition of the limits of the invention.

DESCRIPTION OF EXEMPLARY EMBODIMENTS

Figure 1:
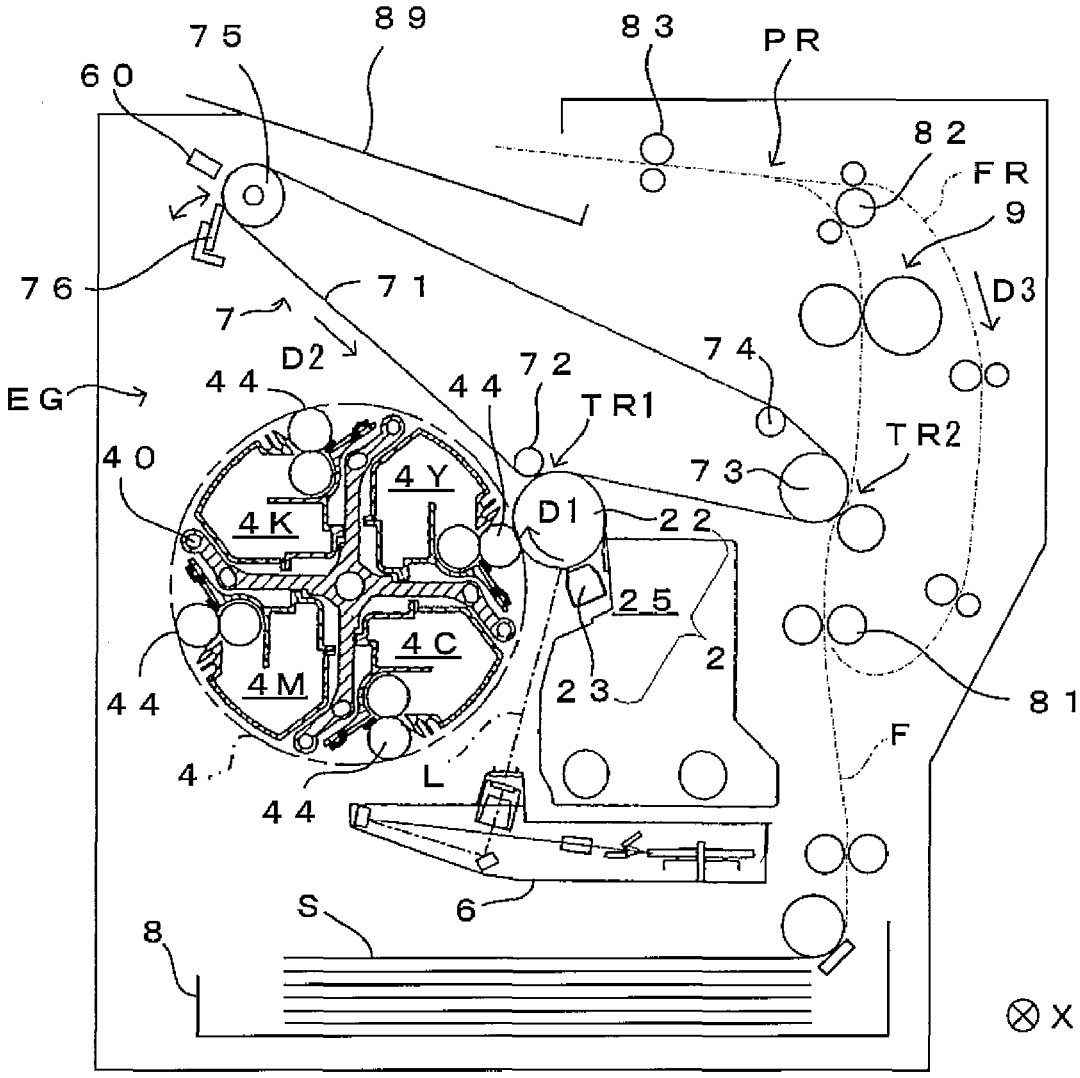
FIG. 1 is a diagram showing an embodiment of an image forming apparatus according to the invention.
Figure 2:
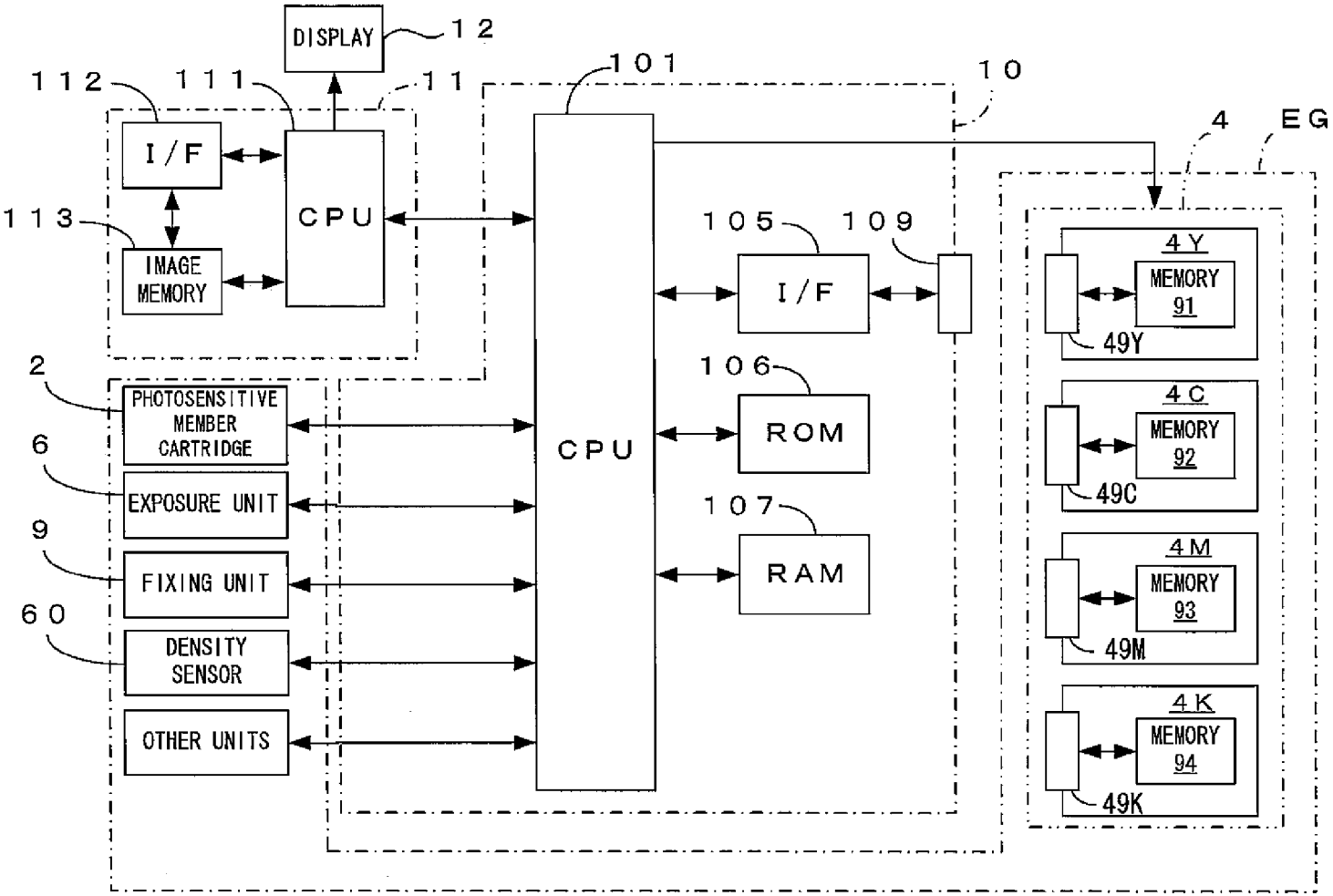
FIG. 2 is a block diagram of an electric structure of the image forming apparatus which is shown in FIG. 1.

FIG. 1 is a diagram showing an embodiment of an image forming apparatus according to the invention. FIG. 2 is a block diagram of an electric structure of the image forming apparatus which is shown in FIG. 1. This apparatus is an image forming apparatus which overlays toner (developing powder) in four colors of yellow (Y), cyan (C), magenta (M) and black (K) one atop the other and accordingly forms a full-color image, or forms a monochromatic image using only black (K) toner. In the image forming apparatus, when an image signal is fed to a main controller 11 from an external apparatus such as a host computer, a CPU 101 provided in an engine controller 10 controls respective portions of an engine part EG in accordance with an instruction received from the main controller 11 to perform a predetermined image forming operation, and accordingly, an image which corresponds to the image signal is formed on a sheet S.

In the engine part EG, a photosensitive member 22 is disposed so that the photosensitive member 22 can freely rotate in an arrow direction D1 shown in FIG. 1. Around the photosensitive member 22, a charger unit 23, a rotary developer unit 4 and a cleaner 25 are disposed in the rotation direction D1. A predetermined charging bias is applied upon the charger unit 23, whereby an outer circumferential surface of the photosensitive member 22 is charged uniformly to a predetermined surface potential. The cleaner 25 removes toner which remains adhering to the surface of the photosensitive member 22 after primary transfer, and collects the toner into a waste toner tank which is disposed inside the cleaner 25. The photosensitive member 22, the charger unit 23 and the cleaner 25, integrated as one, form a photosensitive member cartridge 2. The photosensitive member cartridge 2 can be freely attached to and detached from an apparatus main body as one integrated unit.

An exposure unit 6 emits a light beam L toward the outer circumferential surface of the photosensitive member 22 charged by the charger unit 23. This exposure unit 6 exposes the photosensitive member 22 by the light beam L in accordance with the image signal given from the external apparatus to form an electrostatic latent image corresponding to the image signal.

The developer unit 4 develops thus formed electrostatic latent image with toner. Specifically, the developer unit 4 includes a support frame 40 which is provided rotatable about a rotational axis orthogonal to a plane of FIG. 1 and a yellow developer 4Y, a cyan developer 4C, a magenta developer 4M and a black developer 4K which are freely attachable to and detachable from the support frame 40 and house toner of the respective colors. An engine controller 10 controls the developer unit 4. The developer unit 4 is driven into rotation based on a control instruction from the engine controller 10. When the developers 4Y, 4C, 4M and 4K are selectively positioned at a predetermined developing position which is faced with the photosensitive member 22 over a predetermined gap, the developing roller 44 which is disposed in this developer and carries a toner of a selected color is positioned facing the photosensitive member 22, and the developing roller 44 supplies the toner onto the surface of the photosensitive member 22 at the facing position. As a result, the electrostatic latent image on the photosensitive member 22 is visualized with the toner of the selected color.

Figure 3:
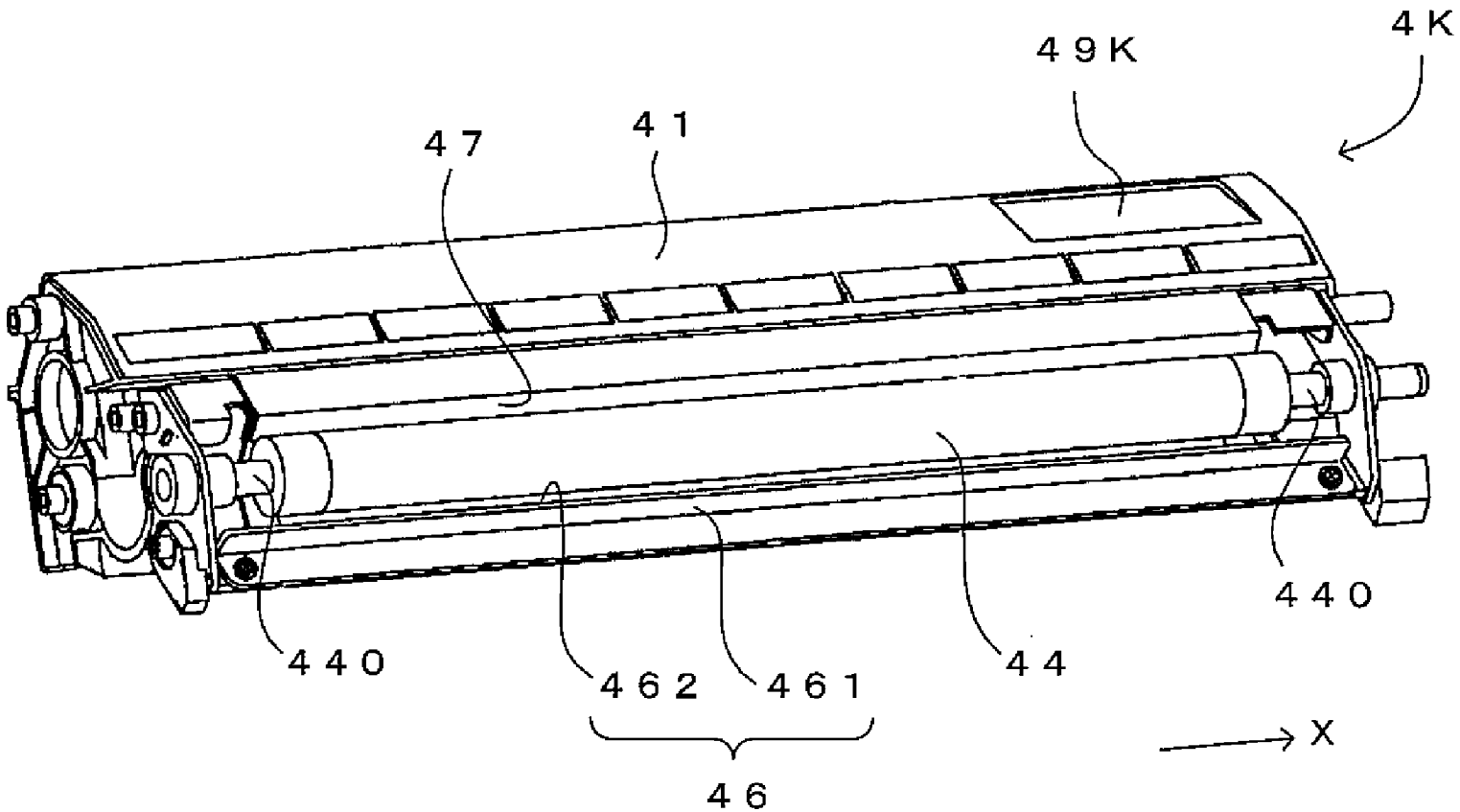
FIG. 3 is a diagram showing the appearance of the developer.
Figure 4A:
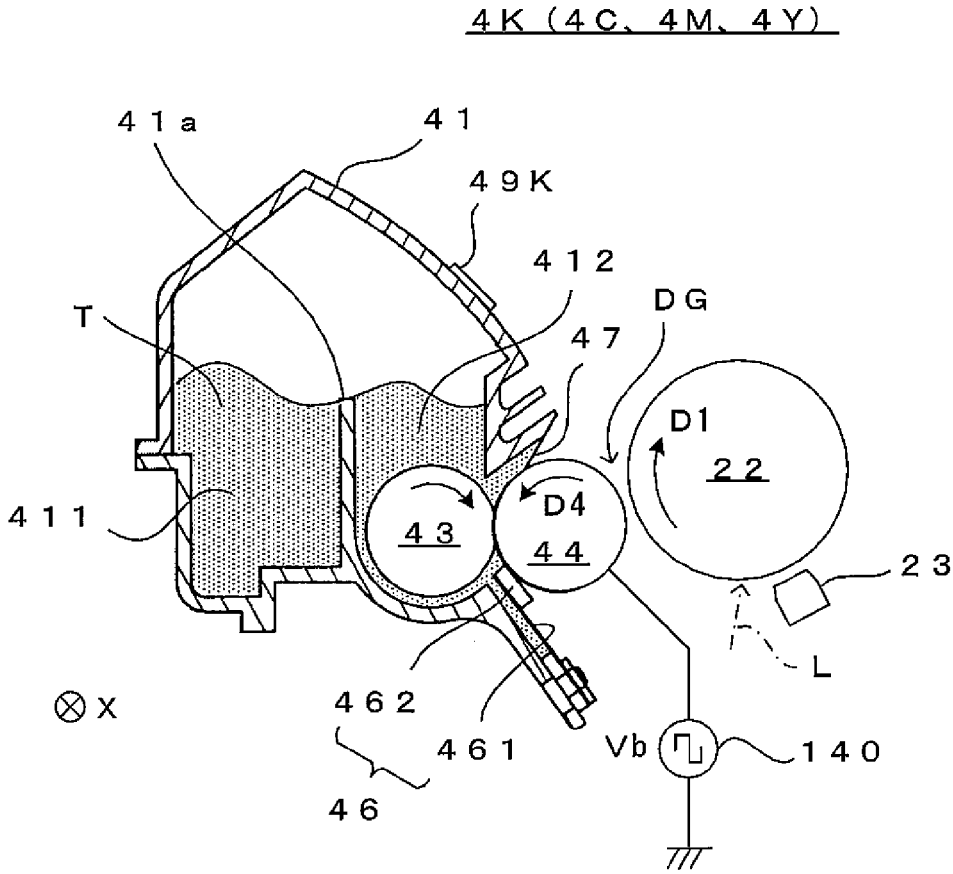
FIG. 4A is a cross sectional view showing a structure of the developer.
Figure 4B:
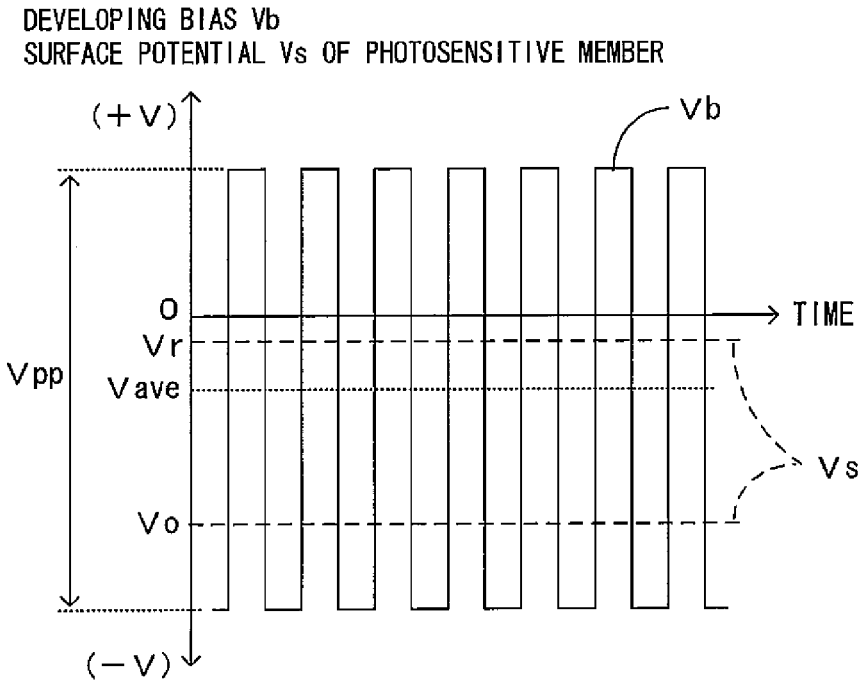
FIG. 4B is a graph showing the relationship between a waveform of a developing bias and a surface potential of the photosensitive member.

FIG. 3 is a diagram showing the appearance of the developer. FIG. 4A is a cross sectional view showing a structure of the developer, and FIG. 4B is a graph showing the relationship between a waveform of a developing bias and a surface potential of the photosensitive member. The developers 4Y, 4C, 4M and 4K have identical structures. Therefore, the structure of the developer 4K will now be described in further detail with reference to FIGS. 3 and 4A. The other developers 4Y; 4C and 4M have the same structures and functions, to be noted.

In the developer 4K, a feed roller 43 and a developing roller 44 are rotatably attached with a shaft to a housing 41 which houses monocomponent toner T inside. When the developer 4K is positioned at the developing position described above, the developing roller 44 is positioned at a facing position which is faced with the photosensitive member 22 over a developing gap DG, and these rollers 43 and 44 are engaged with a rotation driver (not shown) which is provided in the main body to rotate in a predetermined direction. The feed roller 43 is shaped like a cylinder and is made of an elastic material such as foamed urethane rubber and silicone rubber. The developing roller 44 is shaped like a cylinder and is made of metal or alloy such as copper, aluminum and stainless steel. The two rollers 43 and 44 rotate while staying in contact with each other, and accordingly, the toner is rubbed against the surface of the developing roller 44 and a toner layer having a predetermined thickness is formed on the surface of the developing roller 44. Although negatively-charged toner is used in this embodiment, positively-charged toner may be used instead.

The space inside the housing 41 is divided by a partition wall 41*a* into a first chamber 411 and a second chamber 412. The feed roller 43 and the developing roller 44 are both provided in the second chamber 412. With a rotation of these rollers, toner within the second chamber 412 flows and is fed to the surface of the developing roller 44 while getting agitated. Meanwhile toner stored inside the first chamber 411 would not be moved by the rotation since it is isolated from the feed roller 43 and the developing roller 44. This toner is mixed with toner stored in the second chamber 412 and is agitated by the rotation of the developer unit 4 while holding the developer.

As described above, in this developer, the inside of the housing is separated into the two chambers, and the side walls of the housing 41 and the partition wall 41*a* surround the feed roller 43 and the developing roller 44, and accordingly, the second chamber 412 of relatively small volume is provided. Therefore, even when a remaining toner amount is small, toner is supplied efficiently to near the developing roller 44. Further, supply of toner from the first chamber 411 to the second chamber 412 and agitation of the whole toner are performed by the rotation of the developer unit 4. Hence, an auger-less structure is realized that an agitator member (auger) for agitating toner is not provided inside the developer.

Further, in the developer 4K, a restriction blade 46 is disposed which restricts the thickness of the toner layer formed on the surface of the developing roller 44 into the predetermined thickness. The restriction blade 46 includes a plate-like member 461 made of elastic material such as stainless steel, phosphor bronze or the like and an elastic member 462 which is attached to a front edge of the plate-like member 461 and is made of a resin member such as silicone rubber and a urethane rubber. A rear edge of the plate-like member 461 is fixed to the housing 41. The elastic member 462 attached to the front edge of the plate-like member 461 is positioned on the upstream side to the rear edge of the plate-like member 461 in a rotation direction D4 of the developing roller 44 shown by an arrow in FIG. 4. The elastic member 462 elastically abuts on the surface of the developing roller 44 to form a restriction nip, thereby restricting the toner layer formed on the surface of the developing roller 44 finally into the predetermined thickness.

The toner layers thus formed on the surface of the developing roller 44 are transported, by means of the rotation of the developing roller 44, one after another to the opposed positions against the photosensitive member 22 on the surface of which an electrostatic latent image is formed. The developing bias from a bias power source 140 controlled by the engine controller 10 is applied to the developing roller 44. As shown in FIG. 4B, a surface potential Vs of the photosensitive member 22 drops down approximately to a residual potential Vr at exposed segments exposed by the light beam L from the exposure unit 6 after getting uniformly charged by the charger unit 23, but stays at an almost uniform potential V0 at non-exposed segments not exposed by the light beam L. Meanwhile, the developing bias Vb applied to the developing roller 44 is rectangular-wave AC voltage on which a DC potential Vave is superimposed, and its peak-to-peak voltage will be hereinafter denoted at Vpp. With application of such a developing bias Vb, toner carried on the developing roller 44 is made jump across a developing gap DG and partially adheres to the respective sections in the surface of the photosensitive member 22 in accordance with the surface potential Vs of the photosensitive member 22, whereby an electrostatic latent image on the photosensitive member 22 is visualized as a toner image in the color of the toner.

A rectangular-wave voltage having a peak-to-peak voltage of 1500V and a frequency of about 3 kHz, for example, may be used as the developing bias voltage Vb. Since an electric potential difference between the direct current component Vave of the developing bias voltage Vb and a residual potential Vr of the photosensitive member 22 constitutes a so-called development contrast which affects image density, the direct current component Vave may be set to a required value for obtaining a predetermined image density.

The housing 41 further includes a seal member 47 which is pressed against the surface of the developing roller 44 on the downstream side to the opposed position facing the photosensitive member 22 in the rotation direction of the developing roller 44. The seal member 47 is a belt-like film made of a flexible material such as polyethylene, nylon or fluororesin extending in a direction X parallel to a rotational axis of the developing roller 44. One end of the seal member 47 in a direction perpendicular to the direction X is fixed to the housing 41, and the other end of the seal member 47 abuts on the surface of the developing roller 44. The other end of the seal member 47 is allowed to abut on the developing roller 44 as directed toward the downstream side in the rotation direction D4 of the developing roller 44, or directed in a so-called trail direction. The other end of the seal member 47 guides toner which remains on the surface of the developing roller 44 after moving past the opposed position facing the photosensitive member 22 to inside the housing 41 and prevents toner inside the housing from leaking to outside.

Figure 5:
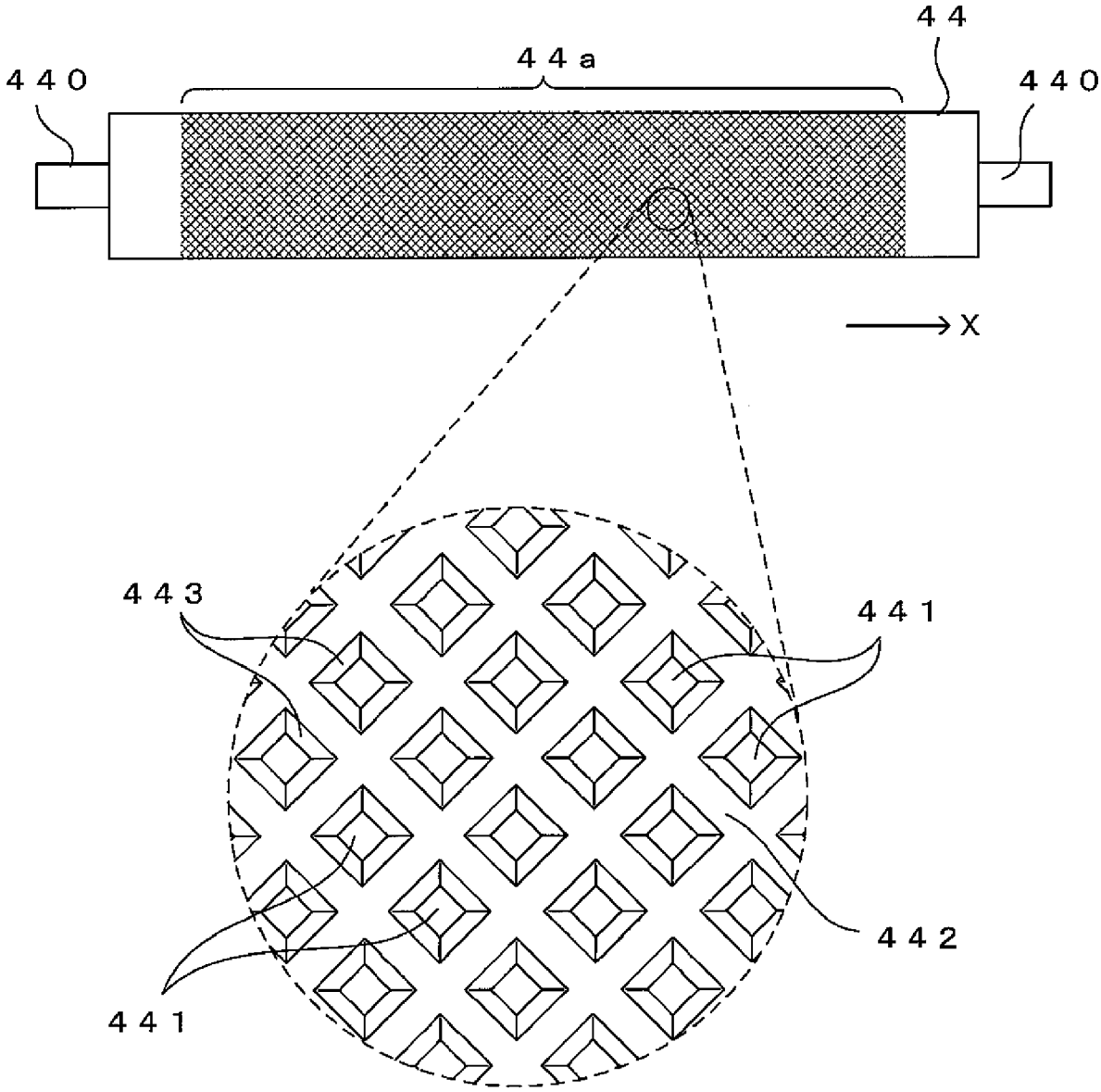
FIG. 5 is a group of diagrams showing a side view of the developing roller and a partially expanded view of the surface of the developing roller.

FIG. 5 is a group of diagrams showing a side view of the developing roller and a partially expanded view of the surface of the developing roller The developing roller 44 is shaped like an approximately cylindrical roller. A shaft 440 is provided at the both ends of the roller in the longitudinal direction of the roller such that the shaft is coaxial with the roller. With the shaft 440 supported by the developer main body, the entire developing roller 44 is freely rotatable. A central area 44*a* in the surface of the developing roller 44, as shown in the partially expanded view in FIG. 5 (inside the dotted-line circle), is provided with a plurality of convex sections 441 which are regularly arranged and a concave section 442 which surrounds the convex sections 441.

Each one of the convex sections 441 projects forward from the plane of FIG. 5, and a top surface of each convex section 441 forms a part of a single cylindrical surface which is coaxial with the rotational axis of the developing roller 44. The concave section 442 is a continuous groove which surrounds the convex sections 441 like a net. The entire concave section 442 also forms a single cylindrical surface which is different from the cylindrical surface which is made by the convex sections and is coaxial with the rotational axis of the developing roller 44. Moderate slants 443 connect the convex sections 441 to the concave section 442 which surrounds the convex sections 441. That is, a normal line to the slants 443 contains a component which is outward in the radius direction of the developing roller 44 (upward in FIG. 5), that is, which is in a direction away from the rotational axis of the developing roller 44. The developing roller 44 having such a structure may be made by the manufacturing method described in JP-A-2007-140080 for instance.

Referring back to FIG. 1, the description of the image forming apparatus is continued. The toner image developed by the developer unit 4 as described above is primarily transferred onto an intermediate transfer belt 71 of a transfer unit 7 in a primary transfer region TR1. The transfer unit 7 includes the intermediate transfer belt 71 mounted on a plurality of rollers 72 to 75 and a driver (not shown) for driving the roller 73 into rotation to rotate the intermediate transfer belt 71 in a specified rotating direction D2. In the case of transferring a color image onto the sheet S, the toner images of the respective colors formed on the photosensitive member 22 are superimposed on the intermediate transfer belt 71 to form the color image, which is secondarily transferred onto the sheet S dispensed one by one from a cassette 8 and conveyed to a secondary transfer region TR2 along a conveyance path F.

At this time, for the purpose of correctly transferring the image on the intermediate transfer belt 71 onto the sheet S at a predetermined position, the timing of feeding the sheet S into the secondary transfer region TR2 is controlled. To be more specific, there is a gate roller 81 disposed in front of the secondary transfer region TR2 on the transportation path F. The gate roller 81 starts to rotate in accordance with the timing of rotation of the intermediate transfer belt 71, and accordingly, the sheet S is fed into the secondary transfer region TR2 at a predetermined timing.

Further, the sheet S on which the color image is thus formed is transported to a discharge tray 89 which is disposed at a top surface of the apparatus main body via a pre-discharge roller 82 and a discharge roller 83 after the toner image is fixed to the sheet S by a fixing unit 9. Meanwhile, when images are to be formed on the both surfaces of the sheet S, the discharge roller 83 starts rotating in the reverse direction upon arrival of the rear end of the sheet S, which carries the image on its one surface as described above, at a reversing position PR located behind the pre-discharge roller 82, thereby transporting the sheet S in the arrow direction D3 along a reverse transportation path FR. The sheet S is returned back to the transportation path F again before arriving at the gate roller 81. At this time, the surface of the sheet S which abuts on the intermediate transfer belt 71 in the secondary transfer region TR2 and is to receive a transferred image is opposite to the surface which already carries the image. In this fashion, it is possible to form images on the both surfaces of the sheet S.

Further, as shown in FIG. 2, the respective developers 4Y, 4C, 4M and 4K comprise memories 91, 92, 93 and 94 respectively which store data related to the production lot, the use history, the remaining toner amount and the like of the developers. In addition, wireless telecommunication devices 49Y, 49C, 49M and 49K are provided in the developers 4Y, 4C, 4M and 4K, respectively. When necessary, the telecommunication devices selectively perform non-contact data telecommunication with a wireless telecommunication device 109 which is provided in the apparatus main body, whereby data transmission between the CPU 101 and the memories 91 through 94 via the interface 105 is performed to manage various types of information regarding the developers such as management of consumables. Meanwhile, in this embodiment, non-contact data transmission using electromagnetic scheme such as wireless telecommunication is performed. However, the apparatus main body and each developer may be provided with connectors and the like, and the connectors may be engaged mechanically to perform data transmission between each other.

Further, as shown in FIG. 2, the apparatus includes a display 12 which is controlled by a CPU 111 of the main controller 11. The display 12 is formed by a liquid crystal display for instance, and shows predetermined messages which are indicative of operation guidance for a user, a progress in the image forming operation, abnormality in the apparatus, the timing of exchanging any one of the units, and the like in accordance with the control command from the CPU 111.

In FIG. 2, a reference numeral 113 represents an image memory provided in the main controller 11 in order to store the image supplied from the external apparatus such as a host computer via the interface 112. A reference numeral 106 represents a ROM for storage of an operation program executed by the CPU 101 and control data used for controlling the engine part EG. A reference numeral 107 represents a RAM for temporary storage of operation results given by the CPU 101 and other data.

Further, there is a cleaner 76 in the vicinity of the roller 75. The cleaner 76 moves nearer to and away from the roller 75 driven by an electromagnetic clutch not shown. In a condition that the cleaner 76 is moved nearer to the roller 75, a blade of the cleaner 76 abuts on the surface of the intermediate transfer belt 71 mounted on the roller 75 and scrapes off the toner remaining on and adhering to the outer circumferential surface of the intermediate transfer belt 71 after the secondary transfer.

Furthermore, a density sensor 60 is disposed in the vicinity of the roller 75. The density sensor 60 confronts a surface of the intermediate transfer belt 71 and measures, as needed, the density of the toner image formed on the outer circumferential surface of the intermediate transfer belt 71. Based on the measurement results, the apparatus adjusts the operating conditions of the individual parts thereof that affects the image quality such as a developing bias applied to each developer, the intensity of the exposure beam L, and tone-correction characteristics of the apparatus, for example.

The density sensor 60 is structured to output a signal corresponding to a contrasting density of a region of a predetermined area defined on the intermediate transfer belt 71 using a reflective optical sensor, for example. The CPU 101 is adapted to detect image densities of individual parts of the toner image on the intermediate transfer belt 71 by periodically sampling the output signals from the density sensor 60 while moving the intermediate transfer belt 71 in rotation.

Restriction of a toner layer on the developing roller 44 within the developer 4K, . . . of the image forming apparatus having the structure above will now be described in detail. In a structure as that described above in which the surface of the developing roller 44 for carrying toner has concavity and convexity, it is possible for both the convex sections 441 and the concave section 442 of the developing roller 44 to carry toner. However, in this embodiment, it is structured that the restriction blade 46 abuts on the developing roller 44 within the surface of the developing roller 44 directly to remove toner on the convex sections 441. The reason is as described below.

First, the distance between the restriction blade 46 and the convex sections 441 needs be controlled precisely in order to form a uniform toner layer on the convex sections 441. However, for carrying of toner only by the concave section 442, the restriction blade 46 may abut on the convex sections 441 and remove all toner on the convex sections 441, which can be realized relatively easily. Further, since the volume of the space defined between the restriction blade 46 and the concave section 442 determines the amount of transported toner, it is possible to stabilize a transported toner amount.

This provides another advantage with respect to superiority of a transported toner layer That is, carrying of toner by the convex sections 441 tends to degrade toner because of friction contact of the toner with the restriction blade 46. More specifically, there are problems such as reduction of the fluidity and the charging performance of toner, clumping together due to toner particles pressed to each other, and filming due to fixedly adherence of toner to the developing roller 44. In contrast, carrying of toner by the concave section 442 which is less influenced by the pressure from the restriction blade 46 is less likely to give rise to such problems. Further, the manner of friction contact on the restriction blade 46 is greatly different between toner carried by the convex sections 441 and toner carried by the concave section 442. Hence, their charge levels are predicted to largely vary from each other. However, carrying of toner by the concave section 442 alone makes it possible to suppress such variations.

The recent years in particular have seen a growing demand for size reduction of toner particles and a lower fixing temperature to enhance the resolution of an image and reduce the amount of consumed toner and electric power consumption. The structure in this embodiment meets the demand. Small-particle toner generally has a high saturation charge level but gets charged slowly at the beginning, and hence, toner carried by the convex sections 441 tends to have a significantly higher charge level (get excessively charged) than toner carried by the concave section 442. Such a charge level difference shows itself as a development history in an image. Further, with respect to toner having a low melting point, fixing of toner to each other and fixing of the toner to the developing roller 44 and the like could easily occur by the friction contact of toner with each other or with the developing roller 44. However, such a problem is less likely to occur in the structure of the embodiment in which only the concave section 442 carries toner.

Figure 6A:
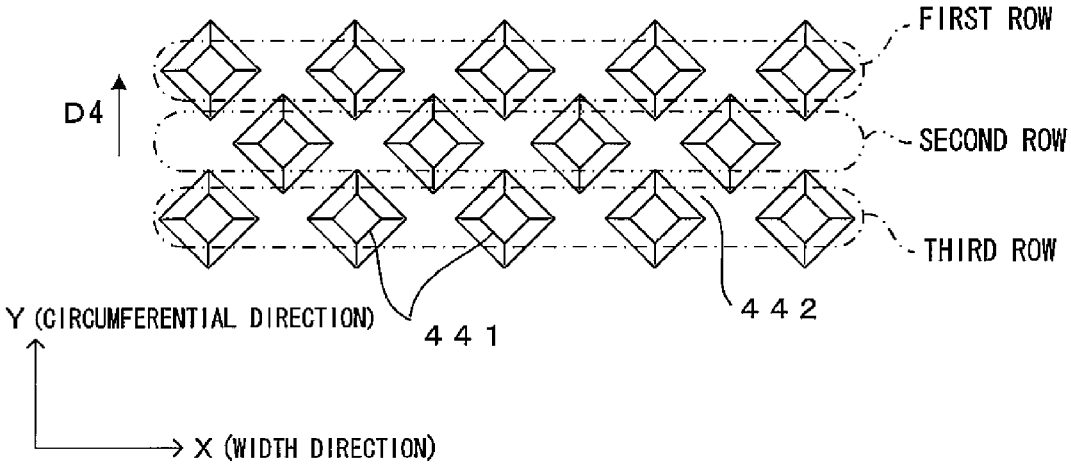
FIGS. 6A and 6B are plan development views showing the structure of the surface of the developing roller in further detail.
Figure 6B:
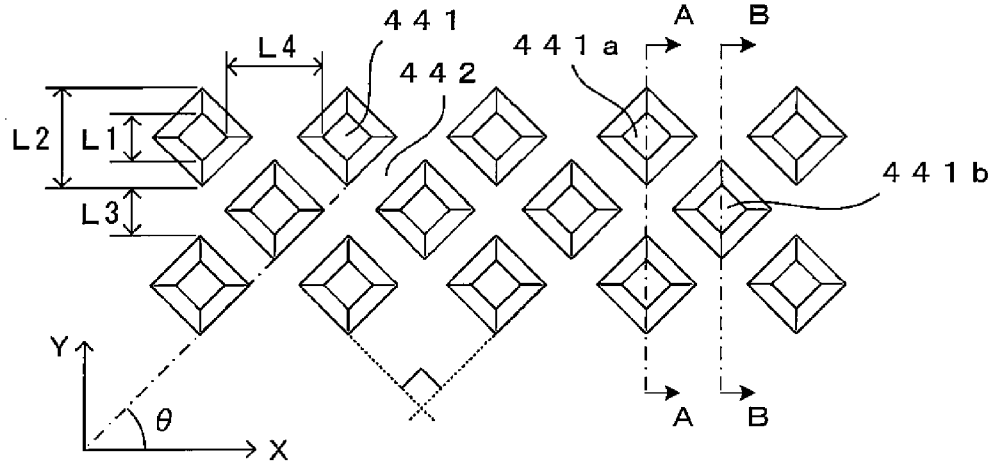

FIGS. 6A and 6B are plan development views showing the structure of the surface of the developing roller in further detail. Each one of the convex sections 441 in the surface of the developing roller 44 has a top section which is shaped like an approximately square projection rotated 45 degrees as shown in FIG. 6A. A number of such convex sections 441 are arranged linearly at equal intervals in the width direction X which is parallel to the rotational axis of the developing roller 44, thereby constituting a convex section row. Further, a plurality of convex section rows are provided in a circumferential direction Y, which is orthogonal to the width direction X, at different positions on the circumferential surface of the developing roller 44. FIG. 6A shows three convex section rows, which will be hereinafter referred to as "the first row", "the second row" and "the third row" from the top in FIG. 6A.

As shown in FIG. 6A, the positions of the convex sections 441 along the width direction X are displaced half the arrangement pitch of the convex sections 441 from each other between the first and the second rows. This holds true as for the positions between the second and the third rows as well. That is, the convex section rows are arranged such that the convex sections 441 are in a staggered pattern in the surface of the developing roller 44. Therefore, it can be said that rows of the convex sections which are arranged in an oblique direction which is at a degree of θ (=45 degrees) with respect to the width direction X on the surface of the developing roller 44.

Dimensions of the respective sections are illustrated with reference to FIG. 6B. Length L1 of a diagonal of the top surface of the convex section 441 is 50 μm both in the X-direction and the Y-direction, and length L2 of a diagonal of the bottom part of the convex section 441 is 100 μm both in the X-direction and the Y-direction. Spacing L3 between the bottom parts of two convex sections located at the same position in the X-direction and adjacent to each other in the Y-direction is 50 μm and spacing between the bottom parts of the convex sections located at the same position in the Y-direction and adjacent to each other in the X-direction is also 50 μm. From these relationships, spacing L4 between two convex sections located at the same position in one direction (X-direction or Y-direction) and adjacent to each other in the other direction is 100 μm. The dimensions of the respective sections are not limited to these numerical values and may be appropriately changed as long as a positional relationship described below is maintained.

Figure 7A:
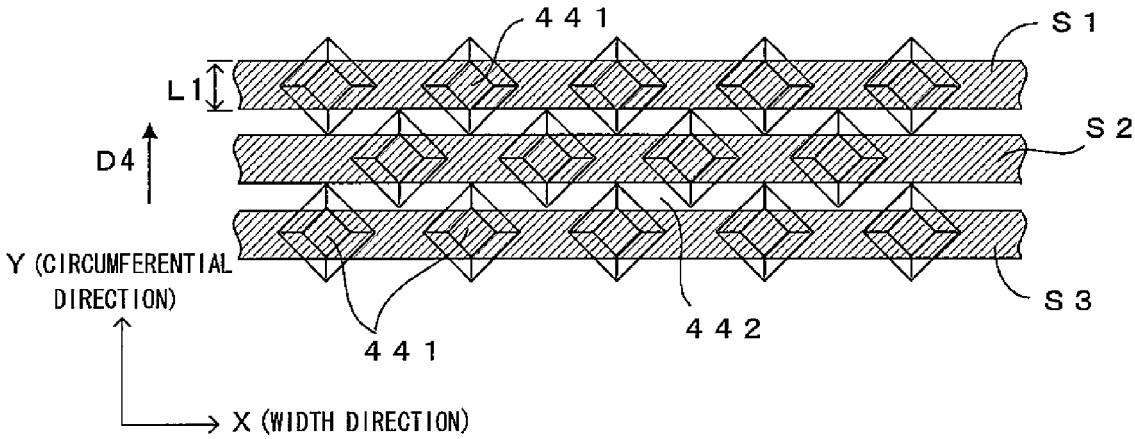
FIGS. 7A, 7B and 7C are diagrams showing the arrangement state of the convex sections in more detail.
Figure 7B:
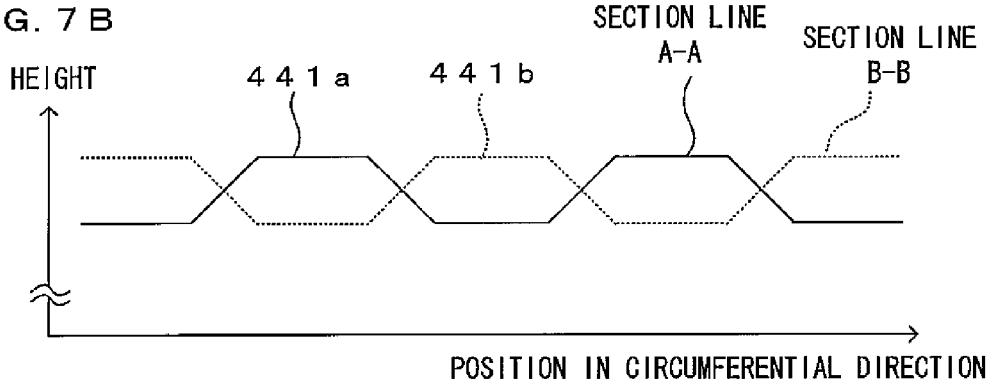
Figure 7C:
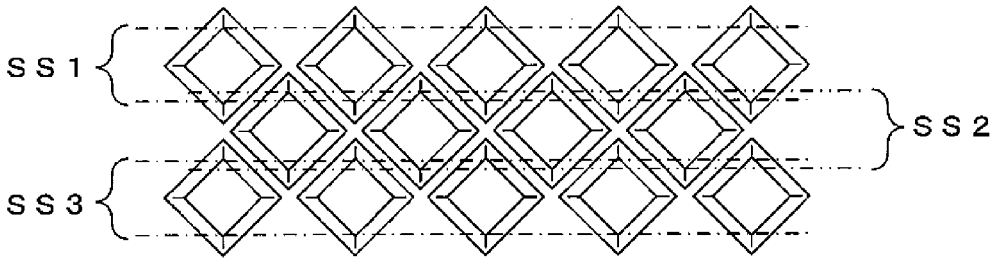

FIGS. 7A, 7B and 7C are diagrams showing the arrangement state of the convex sections in more detail. Virtual surfaces obtained by extending the top surfaces of the respective convex sections 441 in the width direction X are thought. At this time, these surfaces have a reed shape extending in the X-direction and constitute a part of the same cylindrical surface as a cylindrical surface concentric with the rotary shaft of the developing roller 44 and formed by these top surfaces. The surfaces obtained by extending the top surfaces of the convex sections 441 in the width direction X are called "convex section extending surfaces" below. Since the respective convex sections are arranged in a row in the X-direction and identically dimensioned in this embodiment, the convex section extending surfaces of the respective convex sections belonging to this row overlap each other. For example, any of the respective convex sections belonging to the first row share a narrow and long surface S1 having the length L1 of the top surfaces of the convex sections 411 in the Y-direction as a width and extending in the width direction X as shown in FIG. 7A. Similarly, the respective convex sections belonging to the second row share a convex section extending surface S2 and those belonging to the third row share a convex section extending surface S3.

In this embodiment, the convex sections are arranged such that the convex section extending surfaces of the convex sections belonging to different convex section rows do not overlap. In other words, the convex section extending surface S1 of the convex sections belonging to the first row and the convex section extending surface S2 of the convex sections belonging to the second row are parallel to each other while being spaced apart by a specified distance (=(L2−L1)/2) and do not overlap each other. This means the following when viewed in a cross-sectional direction of the developing roller 44.

FIG. 7B is a partial enlarged diagram showing the cross sections of the developing roller 44. More specifically, a cross section of the developing roller 44 along a section line A-A passing the top surfaces of the convex sections 441*a* belonging to a certain convex section row and that of the developing roller 44 along a section line B-B passing the top surfaces of the convex sections 441*b* belonging to an adjacent convex section row as shown in FIG. 6B are shown in a superimposition manner. As shown in FIG. 7B, when viewed in the cross-sectional direction of the developing roller 44, the top surfaces of one convex sections 441*a* and those of the convex sections 441*b* belonging to the convex section row adjacent to the one, to which these convex sections 441*a* belongs, do not overlap each other.

On the other hand, in a comparative example shown in FIG. 7C, the top surfaces of convex sections are large relative to an arrangement pitch of the convex sections, wherefore convex section extending surfaces of the convex sections belonging to adjacent convex section rows partly overlap each other. In other words, a convex section extending surface SS1 of the convex sections belonging to a first row and a convex section extending surface SS2 of the convex sections belonging to a second row partly overlap each other. This also holds true between the convex section extending surface SS2 of the convex sections belonging to the second row and a convex section extending surface SS3 of the convex sections belonging to a third row. In this respect, a configuration of FIG. 7C does not conform to the technical concept of the invention. The reason why the convex section extending surfaces of the convex sections belonging to mutually different convex section rows do not overlap as described above in this embodiment is described next.

Figure 8:
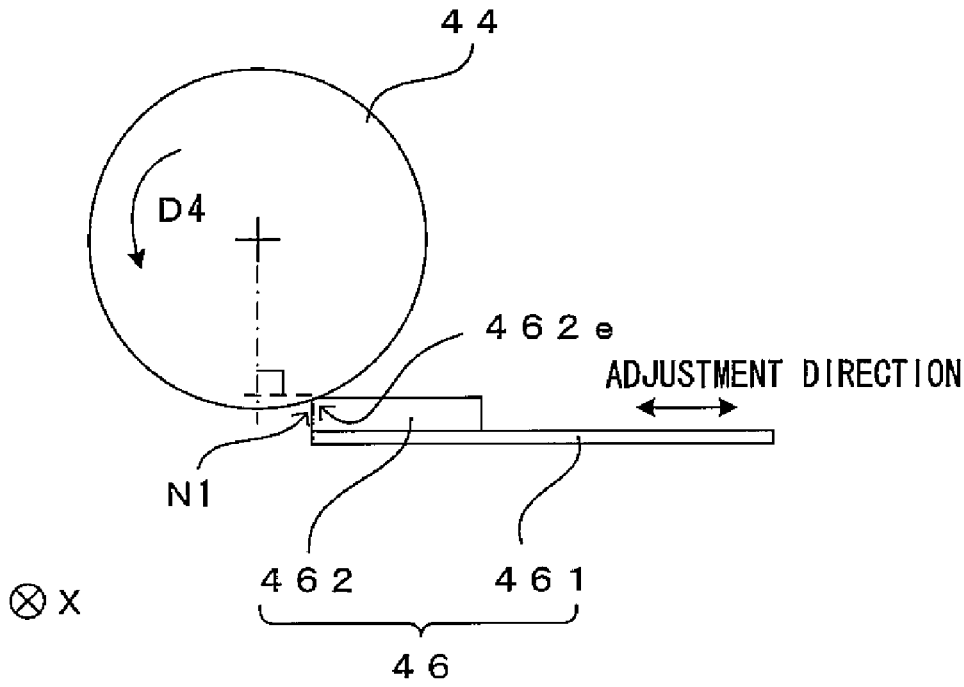
FIG. 8 is a diagram showing a condition of the developing roller and the restriction blade abutting on each other.

FIG. 8 is a diagram showing a condition of the developing roller and the restriction blade abutting on each other. In this embodiment, as shown in FIG. 8, the restriction blade 46 abuts on the surface of the developing roller 44 in a direction against the rotation direction D4 of the developing roller 44, or directed in a so-called counter direction. The elastic member 462 at the tip end of the restriction blade 46 gets pressed by the surface of the developing roller 44 and partially and elastically deformed, whereby a restriction nip N1 is formed in which the surface of the developing roller 44 contacts the elastic member 462. Further, in an upstream-side of the elastic member 462 in the rotation direction D4 of the developing roller 44, an upper edge 462*e* of the elastic member 462 is pressed into contact with the surface of the developing roller 44 to form the restriction nip N1, and toner is restricted by means of the edge restriction.

In the rotation direction D4 of the developing roller 44, the upstream-side end of the elastic member 462 is on the downstream side to a perpendicular from the rotation center of the developing roller 44 to the top surface of the elastic member 462. Hence, the amount of deformation of the elastic member 462 due to elastic deformation near the upstream-side end is maximum at the edge part but decreases toward the downstream side. The width of the restriction nip N1 and the abutting pressure from the elastic member 462 upon the surface of the developing roller 44 can be controlled through adjustment of the position of the restriction blade 46 in an adjustment direction denoted at an arrow in FIG. 8.

Figure 9A:
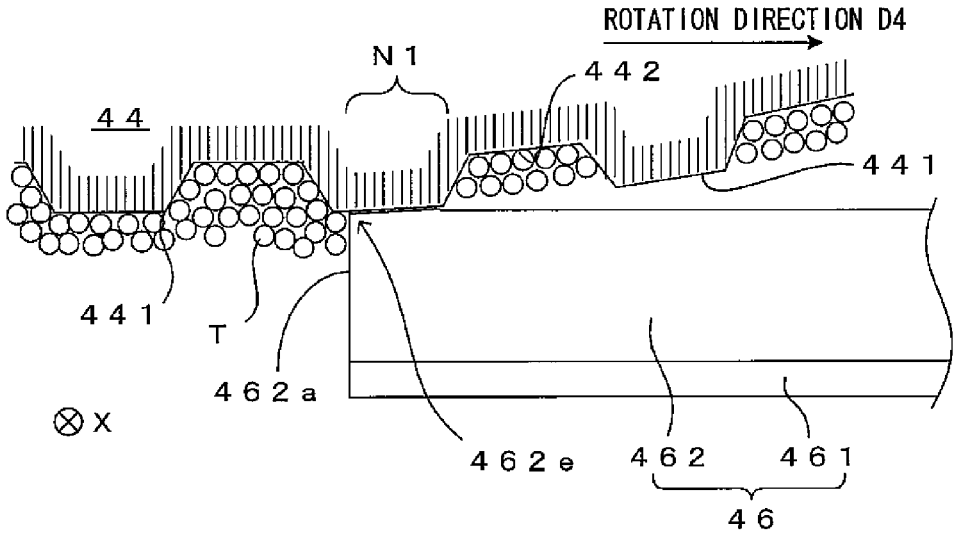
FIGS. 9A, 9B and 9C are enlarged schematic views of the cross section of the restriction nip.
Figure 9B:
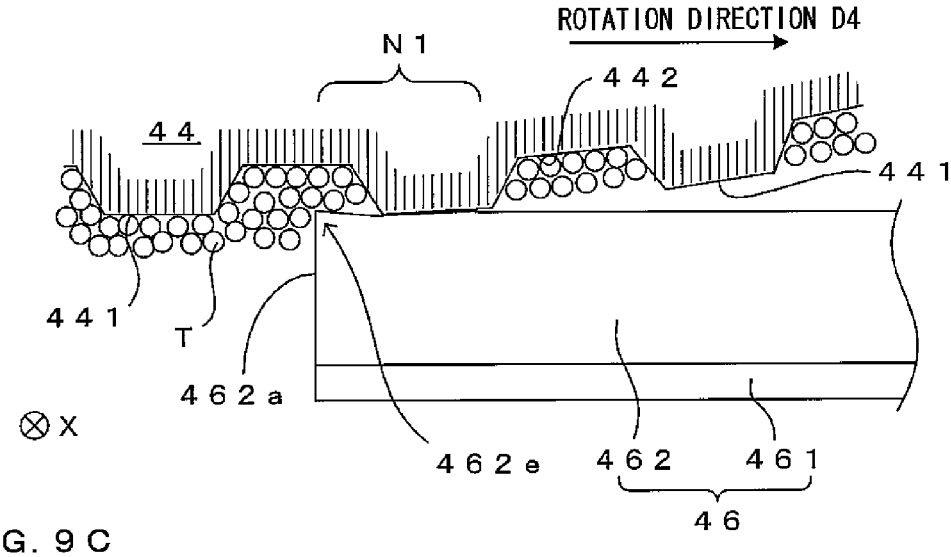
Figure 9C:
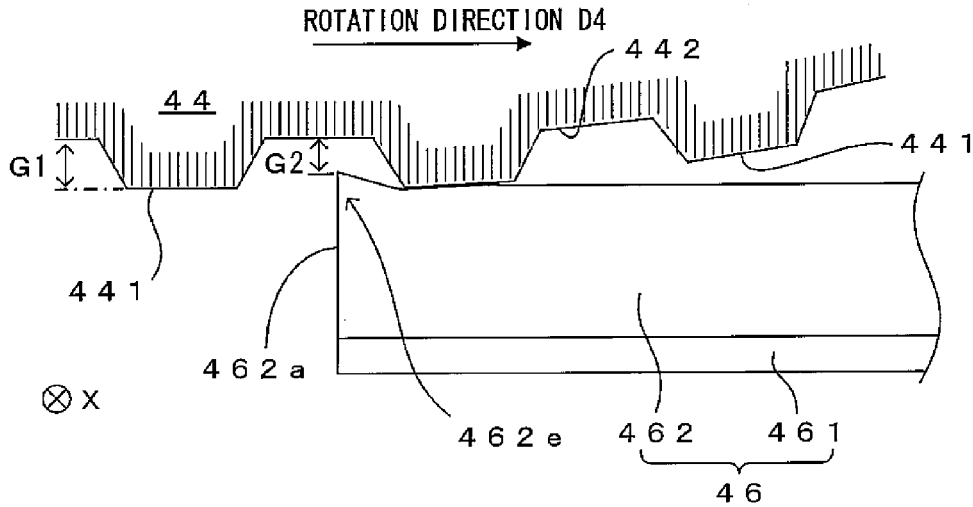

FIGS. 9A, 9B and 9C are enlarged schematic views of the cross section of the restriction nip. Toner is restricted within the restriction nip N1 in the following manner. As shown in FIG. 9A, the elastic member 462 of the restriction blade 46 is pressed against the surface of the developing roller 44, more particularly against the convex sections 441 of the developing roller 44, whereby the restriction nip N1 is formed. The edge 462*e* of the elastic member 462 abuts on the convex sections 441 of the developing roller 44 within the restriction nip N1, and the elastic member 462 is elastically deformed and bent in the vicinity of the convex sections. In the surface of the developing roller 44 on the upstream side (on the left-hand side in FIG. 9A) to the restriction nip N1 in the rotation direction D4 of the developing roller 44, multiple layers of toner are present which have been rubbed against and adhered to both the convex sections 441 and the concave section 442 by the feed roller 43. Of the toner, the elastic member 462 scrapes off a volume of toner carried by the convex sections 441. Hence, within the restriction nip N1 and on the downstream side (on the right-hand side in FIG. 9A) to the restriction nip N1, only the concave section 442 carries toner.

Toner carried on the surface of the developing roller 44 on the upstream side to the restriction nip N1 could contain both favorably charged toner and poorly charged toner. However, as a result of toner layer restriction by the restriction blade 46, toner having a high charge level and strongly adhering to the developing roller 44 stays within the concave section 442. Whereas, since toner having a low charge level is pushed away by the toner having the high charge level, it is unlikely to remain in the concave section 442. Therefore, toner carried by the concave section 442 on the downstream side to the restriction nip N1 is mostly favorably charged toner.

As described above, in order to cause the concave section 442 to selectively carry the satisfactorily charged toner at a side upstream of the restriction nip N1 in the rotation direction D4 of the developing roller 44, an upstream end surface 462*a* of the elastic member 462 is preferably perpendicular to or nearly perpendicular to the surface of the developing roller 44. In this way, the toner on the convex sections 441 can be reliably scraped off and the replacement of the toner in the concave section 442 can be promoted by letting the scraped-off toner remain near the restriction nip N1. Further, in order to ensure the fluidity of the toner near the restriction nip N1, the upstream end surface 462*a* of the elastic member 462 is preferably smoothly finished.

On the other hand, if the upstream end surface 462*a* of the elastic member 462 is inclined toward the surface of the developing roller 44, the toner remaining upstream of the restriction nip N1 is pushed toward the restriction nip N1 to be pressed or the elastic member 462 is raised by the toner present between the restriction nip N1 and the developing roller 44, wherefore proper toner restriction may not be performed. If the upstream end surface 462*a* of the elastic member 462 is inclined in an opposite direction, the scraped-off toner is carried from the vicinity of the restriction nip N1 to a distant position along the upstream end surface 462*a* of the elastic member 462, whereby the replacement of the toner is unlikely to occur.

When the developing roller 44 is rotated in this state, the edge 462*e* of the elastic member 462 moves to a position of the surface of the developing roller 44 facing the concave section 442 as shown in FIG. 9B. At this time, since the leading end of the elastically deformed elastic member 462 is released from the pressure contact with the convex sections 441, the edge 462*e* projects toward the bottom (upper side in FIG. 9B) of the concave section 442. In other words, when a virtual cylindrical surface including the top surfaces of the convex sections 441 is thought, the edge 462*e* enters the inside of this virtual cylindrical surface in the concave section 442. As a result, the edge 462*e* of the elastic member 462 cyclically repeats a state where it is elastically compressed by the contact with the convex sections 441 and a state where it is restored by being released from the pressure contact at a position facing the concave section 442 as the developing roller 44 is rotated. In other words, the leading end of the elastic member 462 moves upward and downward as if it were undulating with the rotation of the developing roller 44.

The edge 462*e* of the elastic member 462 undulates in this way as the developing roller 44 is rotated, whereby an impact is given to the toner carried in and in the vicinity of the concave section 442 by the edge 462*e* of the vibrating elastic member 462 at an upstream end side of the restriction nip N1 in the rotation direction D4 of the developing roller 44. This impact force merely acts to fluidize the toner in the concave section 442 for the toner having small particle diameters and high fluidity. On the other hand, the impact force by the edge 462*e* acts to crush aggregates for toner aggregates formed by massing the toner together to have large particle diameters. In this way, the toner aggregates are crushed utilizing the vibration of the leading end of the elastic member 462 according to the rotation of the developing roller 44 to prevent problems of leakage and scattering of the toner and fogging resulting from the aggregation of the toner and external additives in this embodiment.

Figure 10A:
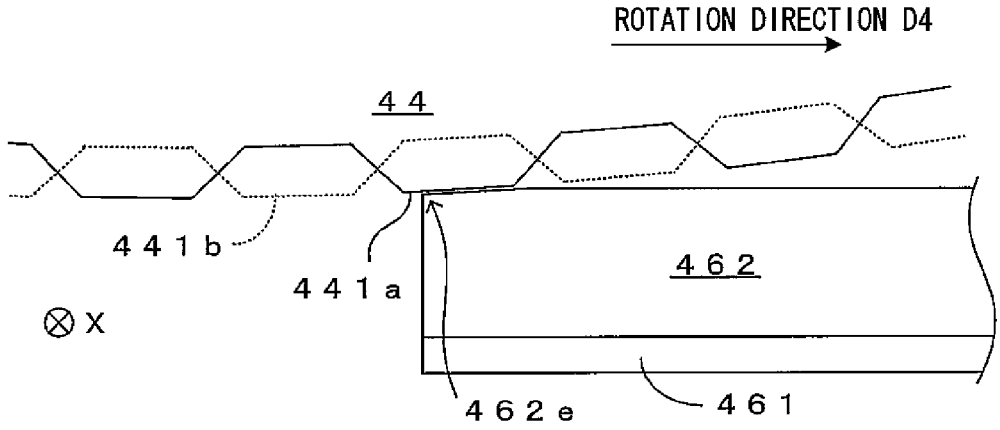
FIGS. 10A, 10B and 10C are diagrams schematically showing a movement of the edge of the elastic member.
Figure 10B:
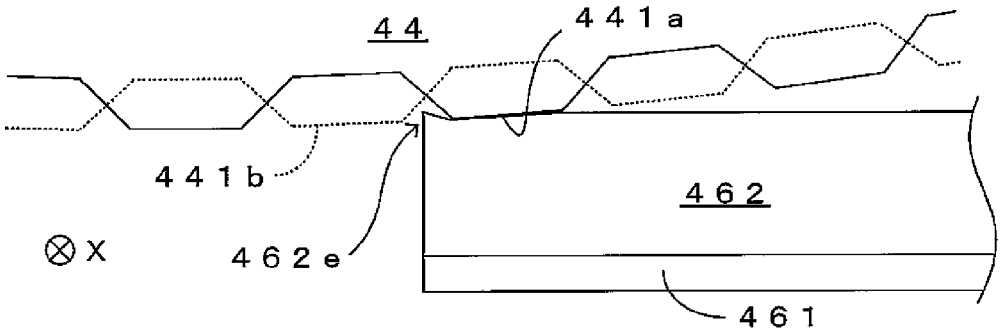
Figure 10C:
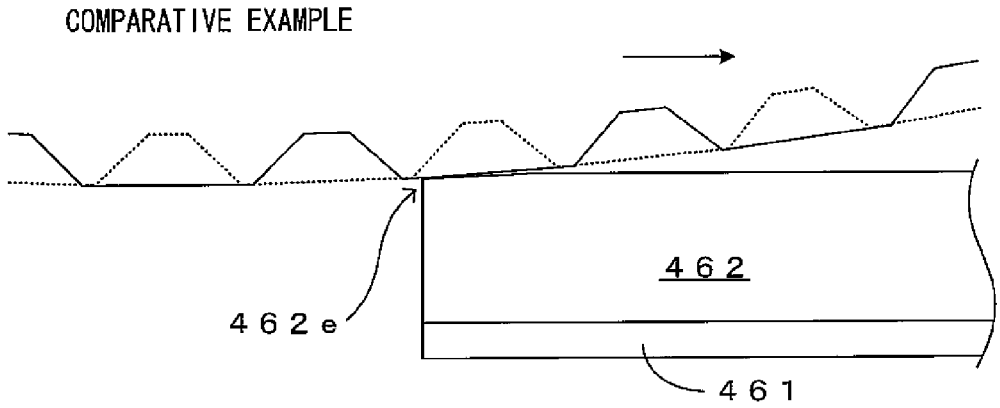

Here, as shown in FIG. 9C, G1 denotes an elevation difference between the convex sections 441 and the concave section 442 and G2 denotes a distance between the edge 462*e* of the elastic member 462 maximally projecting toward the concave section 442 and the bottom of the concave section 442 (hereinafter, this distance is referred to as an "opening height"). Numeral ranges of these values are described later FIGS. 10A, 10B and 10C are diagrams schematically showing a movement of the edge of the elastic member. As shown in FIG. 10A, the elastic member 462 is elastically deformed by the contact with the convex sections with the edge 462*e* of the elastic member 462 held in contact with certain convex sections 441*a*. When the surface of the developing roller 44 further moves, the convex sections 441*a* pass a contact position with the edge 462*e* of the elastic member 462 as shown in FIG. 10B and convex sections 441*b* belonging to another convex section row successively come to a contact position with the edge 462*e*. Here, as described above, the convex section extending surfaces of the convex sections belonging to different convex section rows do not overlap. Thus, there is a period during which the edge 462*e* of the elastic member 462 does not come into contact with any of the top surfaces of the convex sections until coming into contact with the top surfaces of the next convex sections 441*b* after leaving the top surfaces of the previous convex sections 441*a*. During this period, the position where the top surfaces of the convex sections and the edge 462*e* are in contact is not present over the entire range in the width direction X (direction perpendicular to the planes of FIGS. 10A to 10C). Therefore, a vertical movement stroke of the edge 462*e* caused by the rotation of the developing roller 44 can be increased, whereby an effect of crushing the toner aggregates can be improved.

On the other hand, a contact state of the elastic member in the construction of the comparative example shown in FIG. 7C described above is shown in FIG. 10C. As shown in FIG. 10C, the edge 462*e* of the elastic member 462 is constantly in contact with some of the convex sections on the surface of the developing roller. Thus, a vertical movement stroke of the edge 462*e* caused by the rotation of the developing roller 44 is smaller than the one in this embodiment.

For a similar reason, a dimension (nip width) in the circumferential direction Y of the restriction nip N1 narrow and extending in the width direction X is preferably set smaller than the spacing L4 of the convex sections shown in FIG. 6B. By doing so, the elastic member 462 does not simultaneously come into contact with two or more convex sections in the circumferential direction of the developing roller 44. If the elastic member 462 comes into contact with two or more convex sections in the circumferential direction of the developing roller 44, pressure for elastically deforming the elastic member 462 is divided to reduce the vertical movement stroke of the edge 462*e*. On the other hand, when the restriction nip width is set smaller than the spacing L4 of the convex sections to receive the elastic member 462 by one convex section, a large stroke can be obtained and a high crushing effect can be fulfilled.

Figure 11A:
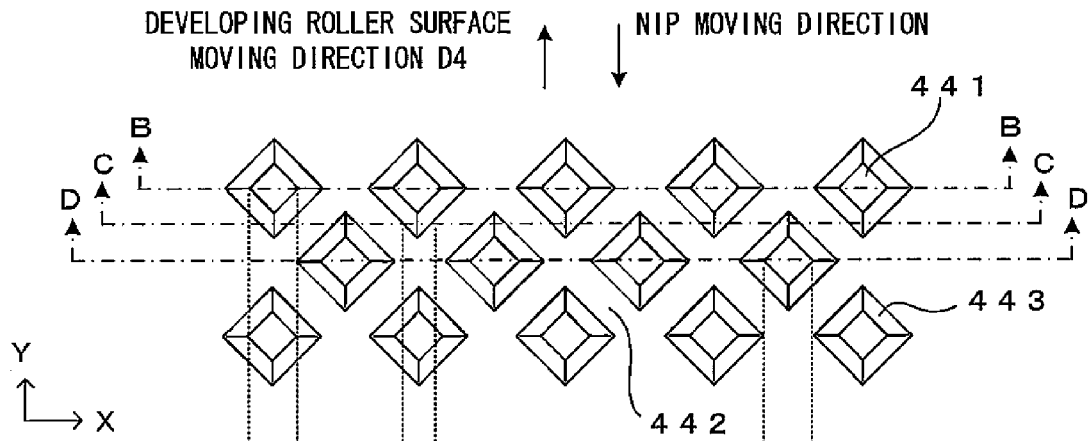
FIGS. 11A, 11B, 11C and 11D are diagrams showing contact states of the developing roller and the elastic member when viewed in the width direction.
Figure 11B:
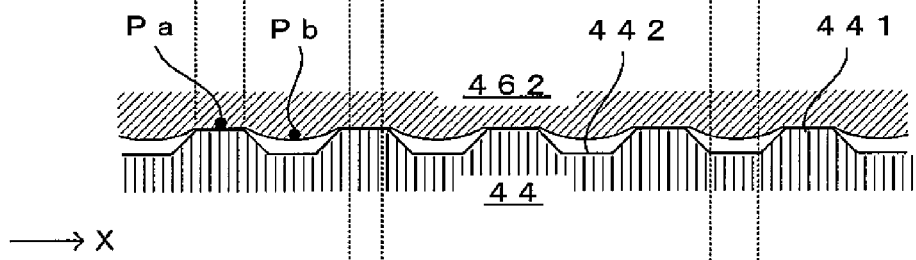

FIGS. 11A, 11B, 11C and 11D are diagrams showing contact states of the developing roller and the elastic member when viewed in the width direction When the edge 462*e* of the elastic member 462 is in contact with the developing roller 44 along a line B-B passing the first row of the convex section rows shown in FIG. 11A, the elastic member 462 is dented at positions held in contact with the convex sections 441 belonging to the first row while projecting toward the concave section 442 at positions facing the concave section 442 as shown in FIG. 11B which is a sectional view taken on line B-B of FIG. 11A. In this way, when viewed in the width direction (X-direction), the edge 462*e* of the elastic member 462 is in a wavy state where parts (position Pa, for instance) dented by the contact with the convex sections 441 and parts (position Pb, for instance) projecting toward the concave section 442 with clearances defined to the concave section 442 are alternately arranged.

Figure 11C:
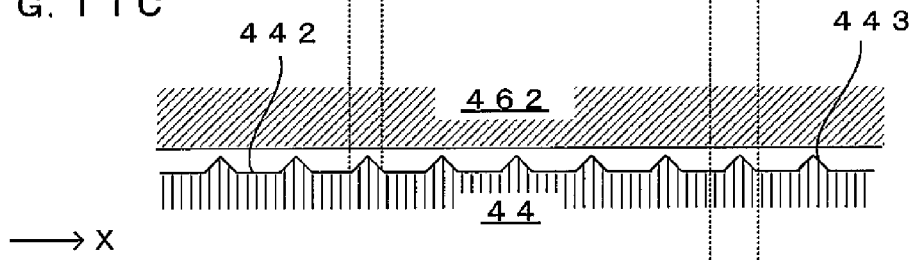
Figure 11D:
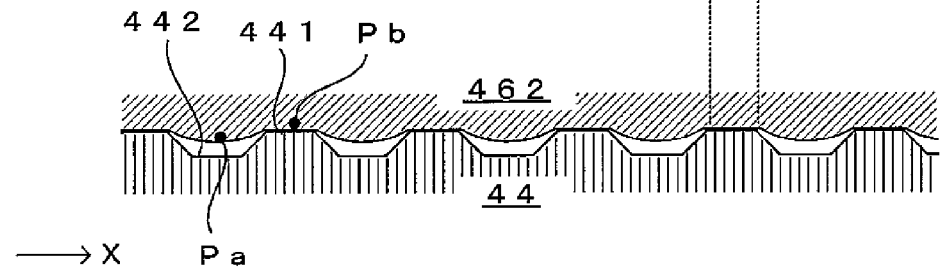

When the surface of the developing roller 44 moves in its rotation direction D4 (upward in FIG. 11A), the restriction nip where the edge 462*e* abuts on the surface of the developing roller 44 relatively moves in the opposite direction (downward in FIG. 11A). When the edge 462*e* arrives at a line C-C passing intermediate between the first row and the second row of the convex section rows shown in FIG. 11A, the top surfaces of the convex sections 441 are not present on the line and the slants 443 which connect the convex sections 441 to the concave section 442 are opposed to the edge 462*e* as shown in FIG. 11C. This allows the edge 462*e* to restore from the elastic deformation and to bulge toward the developing roller 44.

When the edge 462*e* further moves to a line D-D passing the second row of the convex section rows shown in FIG. 11A, the positions Pa which used to abut on the convex sections 441 and sink become opposed against the concave section 442, thereby decreasing the amount of deformation, whereas the positions Pb which used to be opposed against the concave section 442 abuts on the convex sections 441 and sink. In this manner, the respective areas in the edge 462*e* repeatedly abut on and leave the surface of the developing roller 44 as the developing roller 44 rotates, and cyclically wind up and down. Noting how they abut on the convex sections 441, areas in the edge 462*e* which abut on the convex sections 441 of the developing roller 44 are not fixed but move in the width direction as the developing roller 44 rotates.

From the above, in this embodiment, as the developing roller 44 is rotated, the edge 462*e* of the elastic member 462 repeats cyclical vertical movements as a whole while locally makes fine undulating movements. By bringing the elastic member 462 into contact with the surface of the developing roller 44 while vibrating the edge 462*e* in this way, the masses of the toner that came to have large diameters by aggregation are prevented from passing the restriction nip N1. Further, by hitting the toner aggregates by the vibrating edge 462*e*, the aggregates can be crushed. Even for the toner that is not aggregated, the toner can be agitated to further improve the fluidity thereof by giving an impact. In this way, a sufficient amount of toner can be made jump at the position facing the photosensitive member 22 and development performance can be improved. Further, by vibrating the leading end of the elastic member 462, the adhesion of the toner to this part can be prevented.

In the example shown in FIGS. 11A to 11D, there are moments when the entire edge 462*e* of the elastic member 462 is distanced from the surface of the developing roller 44 as shown in FIG. 11C. However, in the technical concept of the invention, it is sufficient that "there are moments when the entire edge 462*e* is not in contact with any of the top surfaces of the convex sections on the surface of the developing roller 44" and it is not necessary that the edge 462*e* is completely distanced from the surface of the developing roller 44.

Figure 12A:
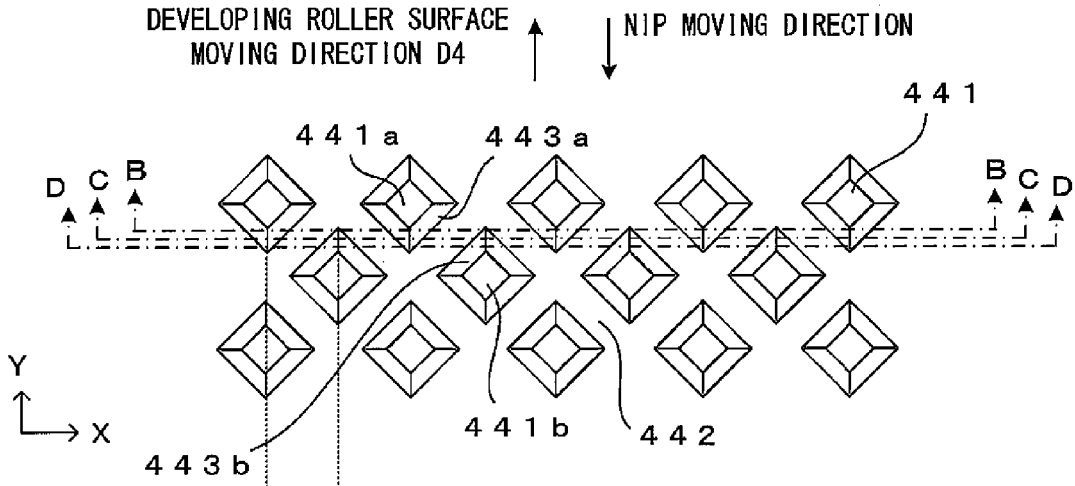
FIGS. 12A, 12B, 12C and 12D are diagrams showing other contact states of the developing roller and the elastic member.
Figure 12B:
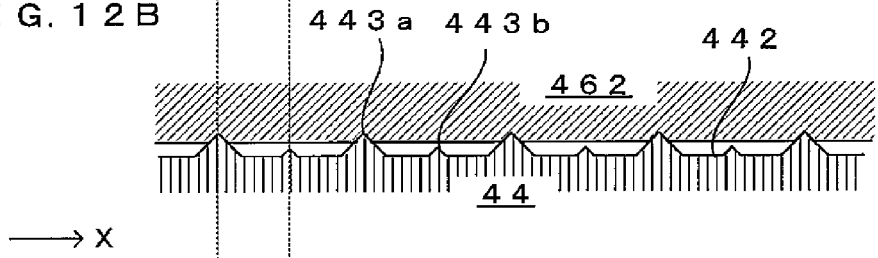
Figure 12C:
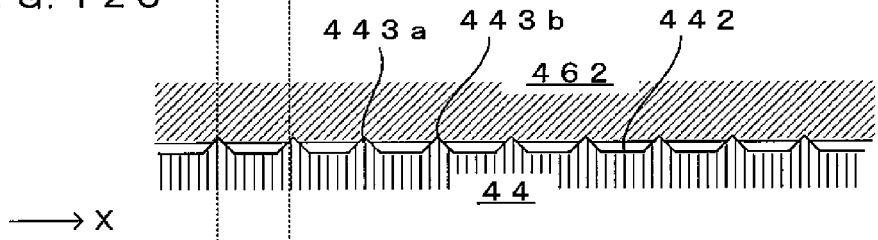
Figure 12D:
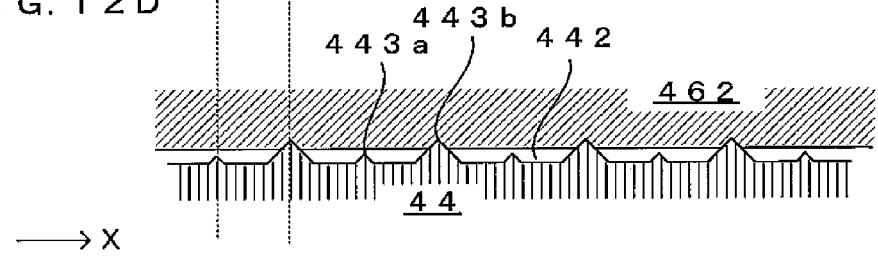

FIGS. 12A, 12B, 12C and 12D are diagrams showing other contact states of the developing roller and the elastic member. In this embodiment, when the edge 462*e* of the elastic member 462 is located on a line C-C passing just in the middle between a first one and a second one of convex section rows shown in FIG. 12A, a ridge line of the slant 443*a* of the convex section 441*a* belonging to the first row and a ridge line of the slant 443*b* of the convex section 441*b* belonging to the second row are both in contact with the elastic member 462 as shown in FIG. 12C. On the other hand, at a time slightly before this, that is, when the edge 462*e* of the elastic member 462 is located on a line B-B shown in FIG. 12A, the edge 462*e* of the elastic member 462 is in contact only with the ridge line of the slant 443*a* of the convex section 441*a* belonging to the first row as shown in FIG. 12B. Further, when the edge 462*e* of the elastic member 462 is located on a line D-D immediately after passing the line C-C shown in FIG. 12A, the edge 462*e* of the elastic member 462 is in contact only with the ridge line of the slant 443*b* of the convex section 441*b* belonging to the second row as shown in FIG. 12D. By doing so, the undulating movements of the edge 462*e* become further finer. As a result, the vibration of the edge 462*e* to finely undulate is coupled with the cyclical vertical movements of the entire edge 462*e*, wherefore the toner aggregates can be more efficiently crushed while the adhesion of the toner to the elastic member 462 is prevented.

Next, it is described at which values the elevation difference G1 between the convex sections 441 and the concave section 442 of the developing roller 44 and the opening height G2 to the edge 462*e* of the elastic member 462 in the concave section 442 shown in FIG. 9C are set. The elevation difference G1 between the convex sections 441 and the concave section 442 of the developing roller 44 is preferably set equal to or larger than a volume average particle diameter Dave of the toner T because of necessity to bear one layer or more of the toner. In other words, it is desirable to satisfy the following formula:

$$G1 \geqq Dave \qquad \text{(Formula 1)}$$

In the meantime, considering variations of a toner particle diameter, the elevation difference G1 between the convex sections 441 and the concave section 442 may be equal to or larger than the diameter of the largest toner particles among toner T. The maximum particle diameter of toner can be defined as described below statistically. That is, the maximum particle diameter Dm can be defined by the following formula:

$$Dm = D50 + 3\sigma \qquad \text{(Formula 2)}$$

where the symbol D50 denotes the 50% particle diameter at the quantity standard of toner T and the symbol σ denotes the geometrical standard deviation. In this way, the proportion of toner whose particle diameter exceeds the maximum particle diameter Dm can be extremely small. When the elevation difference G1 is small, toner having a large particle diameter could stay indefinitely within the developer without getting fed to the concave section 442 so that the particle diameter distribution of toner will gradually shift toward the large diameter side to the extent not usable for development. When the elevation difference G1 is equal to or larger than the maximum particle diameter Dm, the concave section 442 can carry almost all toner particles contained in toner T held inside the developer, which makes it possible to use all toner inside the developer to the very end. That is, it is preferable to satisfy the following formula:

$$G1 \geqq Dm = D50 + 3\sigma \qquad \text{(Formula 3)}$$

The opening height G2 to the edge 462*e* of the elastic member 462 in the concave section 442 is basically similar, but it is desirable that the edge 462*e* projects into the concave section 442 to a certain large extent in the short time to improve the effect of crushing the toner aggregates and the effect of agitating the toner in the concave section 442. However, if the edge 462 excessively projects to reach the bottom of the concave section 442, the toner may be raked out and the conveyance of a sufficient amount of toner cannot be ensured or the toner may be pressed in the concave section 442 to be even more aggregated. Accordingly, even if the edge 462*e* maximally projects, it is at least necessary to leave a certain clearance between the edge 462*e* and the bottom of the concave section 442. In other words, a minimum necessary condition to be satisfied is:

$$G2>0 \quad \text{(Formula 4)}$$

In light of ensuring the sufficient toner conveyance amount, the opening height G2 is preferably large, and may satisfy the following conditions similar to the above elevation difference G1 between the convex sections 441 and the concave section 442:

$$G2 \geqq Dave \quad \text{(Formula 5)}$$

or $$G2 \geqq Dm \quad \text{(Formula 6)}$$

However, if the opening height G2 is excessively large, it is permitted that the toner aggregates having come to have larger diameters by aggregation are carried in the concave section 442. Thus, in reality, it is desirable to suppress the opening height G2 to a value slightly larger than the toner maximum particle diameter Dm at a maximum.

Figure 13:
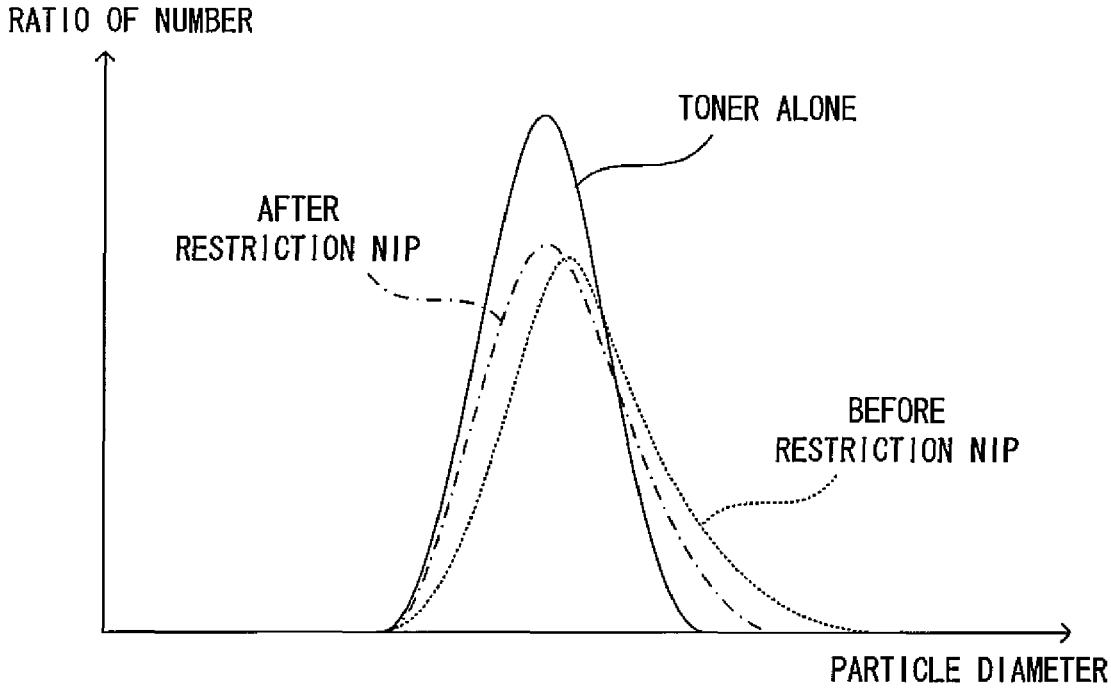
FIG. 13 is a graph showing the toner aggregation crushing effect according to the embodiment.

FIG. 13 is a graph showing the toner aggregation crushing effect according to the embodiment. Toner alone having a particle diameter distribution denoted at the solid line in FIG. 13 was loaded into the image forming apparatus shown in FIG. 1 and the particle diameter distribution of toner carried by the developing roller 44 was measured. The result was that the particle diameter distribution of toner collected from the surface of the developing roller 44 on the front side of, that is, on the upstream side to the restriction nip N1 in the rotation direction of the developing roller 44 was as denoted at the dotted-line curve. One can tell from this result that a number of large-diameter particles which toner alone did not include were carried. Flocculation of toner inside the developer and consequent creation of aggregations seems to be the cause. Meanwhile, the particle diameter distribution of toner collected from the surface of the developing roller 44 after the developing roller moved past the restriction nip N1 was close to the distribution of toner alone in which the proportion of large-diameter particles was smaller than what it was before arrival at the restriction nip and a peak shifted toward the small particle diameter side as denoted at the dashed-dotted line in FIG. 13. It was thus confirmed that the restriction blade 46 according to the embodiment effectively functioned to crush toner aggregations.

Figure 14A:
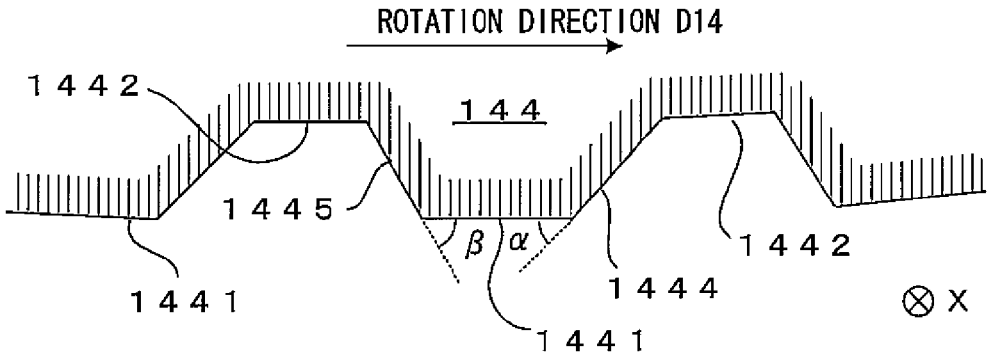
FIGS. 14A and 14B are diagrams showing another embodiment of the developing roller surface structure.
Figure 14B:
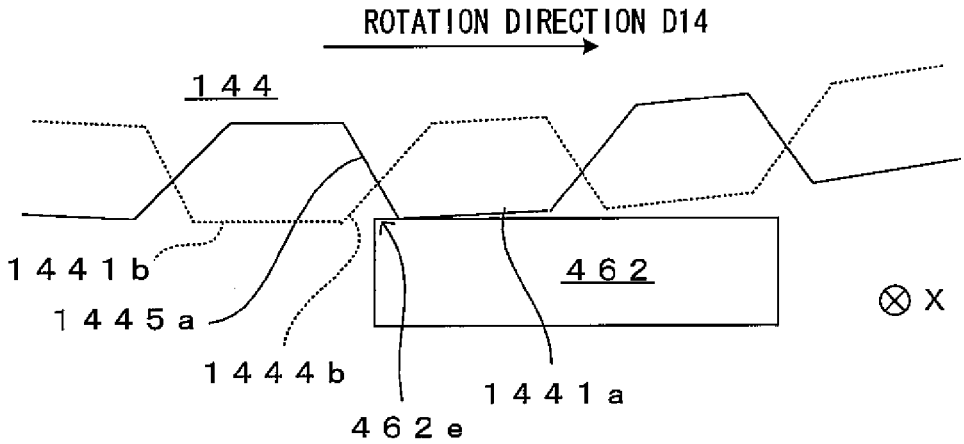

FIGS. 14A and 14B are diagrams showing another embodiment of the developing roller surface structure. Although the respective convex sections 441 are shaped symmetrically with respect to the diagonals of the top surfaces thereof in the above embodiment, the convex sections 441 may be shaped asymmetrically in the circumferential direction instead. In a developing roller 144 of this modified embodiment, the inclination of slants connecting convex sections 1441 and a concave section 1442 differs between front and rear of the convex sections 1441 in a rotation direction D14 of the developing roller 144 as shown in FIG. 14A. Specifically, an angle β indicating the inclination of a slant 1445 at the rear side of the convex section 1441, that is, a side entering the restriction nip later is larger than an angle α indicating the inclination of a slant 1444 at the front side of the convex section 1441 in the rotation direction D14, that is, at a side entering the restriction nip earlier. This can bring about the following advantages.

As shown in FIG. 14B, when the edge 462*e* of the elastic member 462 moves from the convex section 1441*a* belonging to one convex section row to the convex section 1441*b* belonging to the next convex section row as the developing roller 144 is rotated, elastic energy accumulated in the leading end of the elastic member 462 by elastic deformation is released at once to accelerate restoration to the original shape since the slant 1445*a* at the rear side of the convex section 1441*a* earlier held in contact with the edge 462*e* is steep. This has an effect of strengthening a force for hitting the toner to improve the crushing action. In this way, by making the inclination of the rear ones of the slants of the respective convex sections in the rotation direction of the developing roller steeper, the effect of crushing the toner aggregates can be improved.

On the other hand, the edge 462*e* of the elastic member 462 projecting toward the concave section comes into contact with the slant 1444*b* of the convex section 1441*b* to be brought into contact next, and the leading end is elastically deformed to move onto this slant. If the inclination of the slant is moderate at this time, the leading end of the elastic member 462 is more smoothly guided to the top surface of the convex section 1441*b* and there is no likelihood that the edge 462*e* is cracked upon colliding with the slant 1444*b* or becomes large resistance against the rotation of the developing roller 144. In other words, by making the inclination of the front ones of the slants of the respective convex sections in the rotation direction of the developing roller moderate, the crack of the elastic member can be prevented and a load torque can be reduced when viewed from a driving mechanism (not shown) for the developing roller.

Next, an effect in the case where a line in the width direction (X-direction) formed by the edge 462*e* of the elastic member 462 is deviated from an ideal straight line is studied.

Figure 15A:
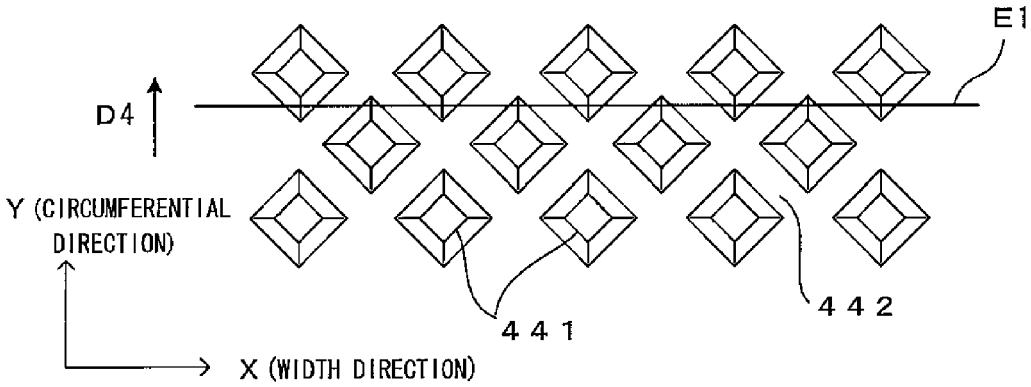
FIGS. 15A, 15B and 15C are diagrams showing lines formed by the edge of the elastic member.
Figure 15B:
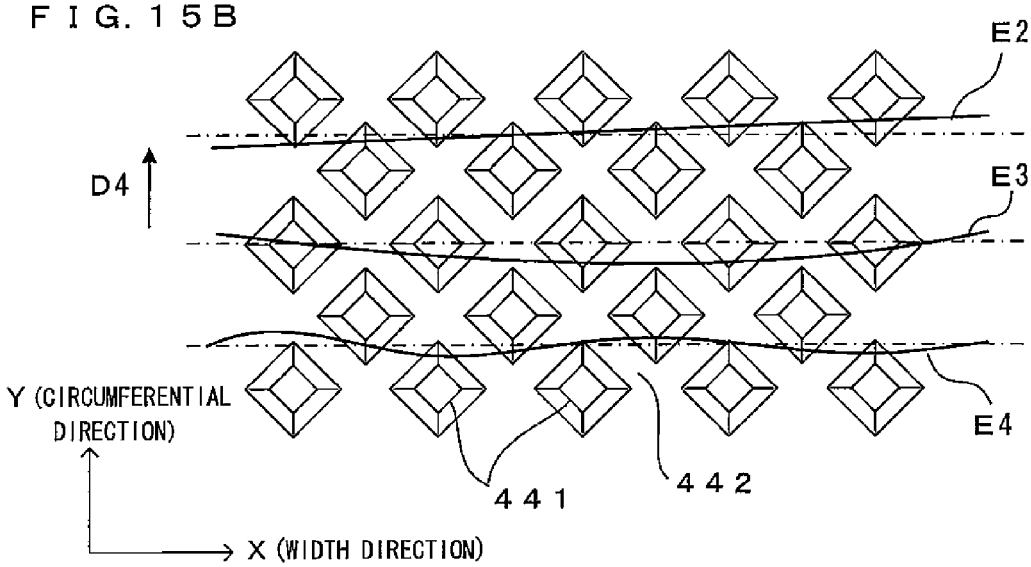
Figure 15C:
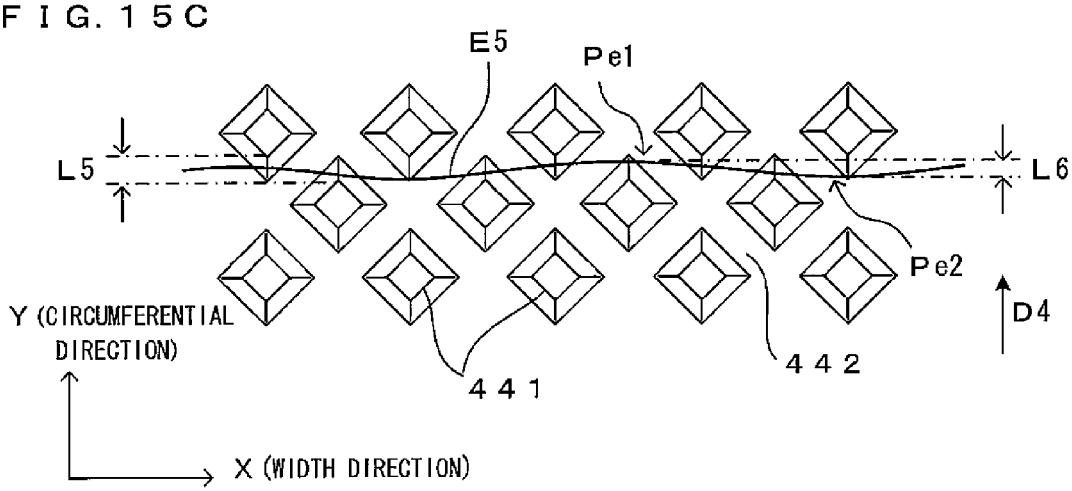

FIGS. 15A, 15B and 15C are diagrams showing lines formed by the edge of the elastic member. The line formed by the edge 462*e* of the elastic member 462 near the surface of the developing roller 44 is ideally a straight line E1 extending in the width direction (X-direction) as shown in FIG. 15A. However, it is not always easy to form such an ideally straight edge of the elastic member 462 made of elastic material. In other words, the line may be slightly skewed from the X-direction like a line E2, may be curved like a line E3, may meander like a line E4 as shown in FIG. 15B or may be a combination of these lines and deviated from the ideal straight line E1. It is essential to which extent such an edge displacement amount can be permitted.

In light of creating a period during which the entire edge 462*e* is released from the pressure contact with the top surfaces of the convex sections 441 in the width direction during the rotation of the developing roller 44, it is sufficient to provide a period during which the entire edge is located between the two convex section extending surfaces S1 and S2 shown in FIG. 7A. It can be understood from this that, regardless of the shape of the line formed by the edge 462*e*, a position difference L6 in the circumferential direction (Y-direction) between a foremost point Pe1 on a line E5 in the rotation direction D4 of the developing roller 44 and a rearmost point Pe2 on the line E5 in the same direction is sufficient to be smaller than the spacing L5 in the circumferential direction between the respective convex sections 441 belonging to two convex section rows adjacent in the circumferential direction (Y-direction) as shown in FIG. 15C.

In practice, the effect of crushing the toner aggregates is obtained if there is any period during which the entire edge

462*e* is released from the pressure contact with the top surfaces of the convex sections 441 in a certain collective area in the width direction. Thus, the above relationship needs not necessarily hold true in the entire area of the edge 462*e*. In other words, if the above relationship holds true in an interval of a specified width (e.g. about several cm) with respect to the entire line formed by the edge 462*e* extending in the width direction, a sufficient effect of crushing the toner aggregates can be practically obtained.

As described above, in this embodiment, the convex sections 441 and the concave section 442 are arranged on the surface of the developing roller 44 such that the convex section extending surfaces obtained by virtually extending the top surfaces of the convex sections 441 in the width direction overlap each other between the convex sections belonging to the same convex section row in the width direction, whereas do not overlap between the convex sections belonging to the different convex section rows. The edge 462*e* of the elastic member 462 disposed in the restriction blade 46 is pressed to the surface of the developing roller 44. By rotating the developing roller 44 in this condition, toner is removed from the convex sections 441 so that excessive pressure is not applied upon toner, and creation of toner aggregations is suppressed. Further, the entire edge 462*e* is moved up and down by repeating elastic deformation and restoration, which makes it possible to prevent toner from being fixed to the elastic member 462 and to crush toner aggregations if any. It is therefore possible in this embodiment to prevent leakage or scattering of toner from the developer, fog, filming, and the like caused by creation of toner aggregations.

While the particle diameter of the toner used in the above embodiment is not particularly limited, a significant effect can be obtained particularly when a toner of a small particle diameter is used. The term "toner of a small particle diameter" as used herein means one having a volume average particle diameter of about 5 μm or less, for example. As the particle diameter of toner decreases, van der Waals' force which acts upon toner increases, and this tendency is particularly notable when the particle diameter of toner is 5 μm or less. Such toner has a very high possibility of adhering to the developing roller 44 or of clumping together of toner with each other due to the van der Waals' force. Further, in the case where a material produced by mixing different substances such as silica and titania is used as an additive which is added to core particles in order to enhance the fluidity of toner, there are some cases that aggregation of toner is caused whose core is an aggregate of the additive. In the apparatus using such toner, the above-described structure makes it possible to effectively prevent the problems such as the leakage, scattering, and image defects resulting from the toner aggregation.

It should be noted that the invention is not limited to the embodiments above, but may be modified in various manners in addition to the embodiments above, to the extent not deviating from the object of the invention. For example, although the convex sections 441 of the developing roller 44 are lozenge-shaped in the above embodiments, this is not limiting The convex sections may be shaped differently such as circles and triangles for instance.

Although the developing roller 44 is metallic cylinder in the above embodiments, the invention is also applicable to an apparatus comprising a developing roller made of other material. However, experiments performed by the inventors of the invention have identified that the effect of applying the invention was remarkable when a developing roller whose surface is made of a conductive material such as a metallic developing roller and a developing roller made of non-metal with metal-plating thereon is used. In this respect, the invention is also effective to an apparatus comprising a developing roller which is made conductive by dispersing a conductive material such as carbon black or metallic fine powder in a cylinder made of rubber, resin or the like for instance.

Further, although the restriction blade 46 is prepared by attaching the elastic member 462 made of resin to a plate-like member 461 made of metal in the embodiment above, this structure is not limiting. The restriction blade may be a metal plate coated with resin, for example. In addition, since it is not necessary that the blade is conductive, the whole of a restriction blade may be made of resin.

The image forming apparatus in the above embodiment is a color image forming apparatus in which the developers 4 K, . . . are attached to the rotary developer unit 4. However, the application of the invention is not limited to this. The invention is also applicable to a so-called tandem type color image forming apparatus in which a plurality of developers are arranged along an intermediate transfer belt, and to a monochromatic image forming apparatus which includes only one developer and forms a monochromatic image for example.

As described above, in the embodiment above, the photosensitive member 22 and the developing roller 44 function as an "image carrier" and a "toner carrier roller" of the invention, respectively. Further, the restriction blade 46 functions as a "restriction member" of the invention and the elastic member 462 functions as an "elastic abutting member" of the invention.

In an embodiment according to the invention, in a state where the edge part of the elastic abutting member faces a concave section surrounding the convex sections on the toner carrier roller surface, a spacing between the edge part and the concave section is preferably larger than zero. If the edge part excessively projects into the concave section, a force for pressing the toner carried in the concave section increases to give an excessive pressure to the toner. In order to prevent this, a certain clearance is preferably defined between the edge part and the concave section even in a state where the edge part faces the concave section and projects toward the bottom of the concave section.

For example, the spacing between the edge part and the concave section can be made larger than the volume average particle diameter of the toner in a state where the edge part of the elastic abutting member faces the concave section. By doing so, at least one layer of toner not pressed by the restriction member can be carried in the concave section.

Further, the spacing between the edge part and the concave section may be larger than a maximum particle diameter of the toner. This makes it possible for the concave section to carry toner having a maximum particle diameter. This solves a problem that only toner having a large particle diameter is left unused. The maximum particle diameter of toner can be defined for instance as a value which is calculated by adding triple the geometrical standard deviation to the 50% particle diameter at the quantity standard in the particle diameter distribution of the toner. This makes it possible for the concave section to carry almost all (approximately 99.7% of) toner particles.

It is preferable that an upstream one of end surfaces of the elastic abutting member in the rotation direction of the toner carrier roller is substantially perpendicular to the surface of the toner carrier roller. By doing so, a stable amount of the toner can be carried in the concave section by preventing the toner in the concave section from being raked out more than necessary and the restriction member from being lifted up from the toner carrier roller by excessive toner.

A position difference in the circumferential direction between a foremost part and a rearmost part of the edge part of the elastic abutting member in the rotation direction of the toner carrier roller is preferably smaller than a spacing in the circumferential direction between two adjacent convex section extending surfaces.

The edge part of the elastic abutting member is ideally perfectly straight in the width direction, but it is not always like that in an actual apparatus. There is a possibility that the straight line formed by the edge part is slightly skewed from the width direction or the edge part is curved or wavy other than being straight. It is preferable to permit such a slight displacement of the edge part. However, if this displacement is excessively large, there exists no period during which the entire edge part is released from the pressure contact with the convex sections and the effect of crushing the toner aggregates is weakened. As described above, when the position difference in the circumferential direction between the foremost part of the edge part in the rotation direction of the toner carrier roller and the rearmost part thereof in the rotation direction is kept in such a range as to be smaller than the spacing between two adjacent convex section extending surfaces, the period during which the entire edge part is released from the pressure contact with the convex sections inevitably exists and the effect of crushing the toner aggregates can be effectively fulfilled.

Further, the width in the circumferential direction of a restriction nip formed by the contact of the elastic abutting member with the toner carrier roller is preferably smaller than a spacing between two convex sections belonging respectively to the convex section rows adjacent in the circumferential direction. The nip width smaller than the spacing between the convex sections means that the elastic abutting member does not simultaneously come into contact with two or more convex section rows. In such a case, a displacement amount of the edge part can be larger than in the case where the nip width is large and the elastic abutting member simultaneously comes into contact with two or more convex section rows, wherefore the effect of crushing the toner aggregates by the edge part can be improved.

The positions of the respective convex sections in the width direction may mutually differ between two convex section rows adjacent in the circumferential direction. By doing so, the contact positions of the elastic abutting member with the convex sections cyclically differ as the toner carrier roller is rotated. Thus, the edge part of the elastic abutting member undergoes a complicated deformation accompanied by undulating movements, wherefore the effect of crushing the toner aggregates can be improved and the adhesion of the toner to the elastic abutting member can be prevented.

With respect to the toner carrier roller, it is preferable that a normal line to side surface parts which connect the convex sections to the concave section contains a component which is in a direction away from the rotational axis of the toner carrier roller. In other words, it is preferable that the convex sections and the concave section are connected to each other by moderate slants. The convex sections are one after another fed to abutting zones with the elastic abutting member and are brought into friction contact with the edge part as the toner carrier roller rotates. However, since the surfaces which connect the convex sections to the concave section are moderate slants, the edge part will not get stuck at the side surfaces of the convex sections and the drive torque of the toner carrier roller will therefore be small. In addition, it is possible to prevent permanent deformation, chipping and the like of the edge part at those areas of the edge part which abut on the convex sections first.

In this instance, it is preferable that a gradient of the side surface parts is steeper on the rear side to the convex sections rather than on the front side to the convex sections in the rotation direction of the toner carrier roller. This makes the edge part abut on the moderate slants and accordingly, the edge part is elastically deformed gradually on the front-end side of the convex sections which move toward the edge part in accordance with rotation of the toner carrier roller, whereas the deformation is mitigated on rear-end side of the convex sections at once in a short period of time. Hence, the striking force upon toner increases further and the crushing effect upon toner aggregations enhances.

This invention exhibits a particularly remarkable effect in the case of application to a developer apparatus in which the volume average particle diameter of the toner is 5 μm or smaller. Since van der Waals' force acting between toner particles are strong in such toner with small particle diameters, the aggregation of the toner is likely to occur. Particularly in an apparatus employing a jumping developing method using nonmagnetic monocomponent toner, the fluidity of the toner needs to be increased so that a sufficient amount of toner jump. Specifically, the added amount of additives with small particle diameters such as silica and titania needs to be increased. Thus, free additives tend to increase, the additives are likely to be separated from toner base particles and the fluidity thereof is likely to decrease with time. Therefore, toner aggregates are easily formed. By applying the invention to an apparatus using such toner, various problems resulting from the formation of toner aggregates can be effectively solved.

Although the invention has been described with reference to specific embodiments, this description is not meant to be construed in a limiting sense. Various modifications of the disclosed embodiment, as well as other embodiments of the present invention, will become apparent to persons skilled in the art upon reference to the description of the invention. It is therefore contemplated that the appended claims will cover any such modifications or embodiments as fall within the true scope of the invention.

What is claimed is:

1. A developer apparatus, comprising:

a toner carrier roller that rotates while carrying a toner layer of charged toner on a surface thereof, and is provided, on the surface thereof, with plural convex section rows, each of which has plural convex sections arranged in a row in a width direction parallel to a rotational axis of the toner carrier roller and which are arranged in a circumferential direction orthogonal to the width direction and parallel to a circumferential surface of the toner carrier roller, the convex sections being so constructed and arranged that top surfaces of the convex sections coincide with a part of a curved surface of a single cylinder having a shape corresponding to that of the toner carrier roller; and a restriction member that abuts on the surface of the toner carrier roller to restrict the toner layer carried on the surface of the toner carrier roller, includes an elastic abutting member which is made of an elastic material and has an edge part which extends in the width direction, the edge part being pressed into contact with the surface of the toner carrier roller, wherein a virtual surface which is obtained by extending the top surface of each convex section in the width direction and forms a part of the curved surface of the single cylinder is defined as a convex section extending surface of each convex section, the convex section extending surfaces overlap each other between the convex sections belonging to the same convex section row, whereas the convex section extending surfaces are spaced apart between the convex sections belonging to mutually different convex section rows, and a width in the circumferential direction of a restriction nip that is formed by contact of the elastic abutting member with the toner carrier roller is smaller than a spacing between two convex sections belonging to convex section rows adjacent in the circumferential direction.

2. The developer apparatus according to claim 1, wherein the toner carrier roller is provided, on the surface thereof with a concave section which surrounds the convex sections, and a spacing between the edge part of the elastic abutting member and the concave section is larger than zero in a state where the edge part faces the concave section of the surface of the toner carrier roller.

3. The developer apparatus according to claim 2, wherein the spacing between the edge part of the elastic abutting member and the concave section is larger than a volume average particle diameter of the toner in a state where the edge part faces the concave section.

4. The developer apparatus according to claim 3, wherein the spacing between the edge part of the elastic abutting member and the concave section is larger than a maximum particle diameter of the toner in a state where the edge part faces the concave section.

5. The developer apparatus according to claim 1, wherein an upstream end surface of end surfaces of the elastic abutting member in a rotation direction of the toner carrier roller is substantially perpendicular to the surface of the toner carrier roller.

6. The developer apparatus according to claim 1, wherein a position difference in the circumferential direction between a foremost part and a rearmost part of the edge part of the elastic abutting member in the rotation direction of the toner carrier roller is smaller than a spacing in the circumferential direction between two adjacent convex section extending surfaces.

7. The developer apparatus according to claim 1, wherein positions of the respective convex sections in the width direction mutually differ between two convex section rows adjacent in the circumferential direction.

8. The developer apparatus according to claim 1, wherein the toner carrier roller is provided with a side surface part which connects the convex section to the concave section, and a normal line to the side surface part contains a component which is in a direction away from the rotational axis of the toner carrier roller.

9. The developer apparatus according to claim 8, wherein a gradient of the side surface part is steeper on a rear side to the convex section rather than on a front side to the convex section in the rotation direction of the toner carrier roller.

10. The developer apparatus according to claim 1, wherein a volume average particle diameter of the toner is equal to or smaller than 5 μm.

11. An image forming apparatus, comprising:

an image carrier that carries an electrostatic latent image;

a toner carrier roller that is arranged opposed to the image carrier, rotates while carrying a toner layer of charged toner on a surface thereof, and is provided, on the surface thereof, with plural convex section rows, each of which has plural convex sections arranged in a row in a width direction parallel to a rotational axis of the toner carrier roller and which are arranged in a circumferential direction orthogonal to the width direction and parallel to a circumferential surface of the toner carrier roller, the convex sections being so constructed and arranged that top surfaces of the convex sections coincide with a part of a curved surface of a single cylinder having a shape corresponding to that of the toner carrier roller; and a restriction member that abuts on the surface of the toner carrier roller to restrict the toner layer carried on the surface of the toner carrier roller, includes an elastic abutting member which is made of an elastic material and has an edge part which extends in the width direction, the edge part being pressed into contact with the surface of the toner carrier roller, wherein a virtual surface which is obtained by extending the top surface of each convex section in the width direction and forms a part of the curved surface of the single cylinder is defied as a convex section extending surface of each convex section, the convex section extending surfaces overlap each other between the convex sections belonging to the same convex section row, whereas the convex section extending surfaces are spaced apart between the convex sections belonging to mutually different convex section rows, and a width in the circumferential direction of a restriction nip that is formed by contact of the elastic abutting member with the toner carrier roller is smaller than a spacing between two convex sections belonging to convex section rows adjacent in the circumferential direction.

12. An image forming method, comprising:

preparing a toner carrier roller that rotates while carrying a toner layer of charged toner on a surface thereof, and is provided, on the surface thereof, with plural convex section rows, each of which has plural convex sections arranged in a row in a width direction parallel to a rotational axis of the toner carrier roller and which are arranged in a circumferential direction orthogonal to the width direction and parallel to a circumferential surface of the toner carrier roller, the convex sections being so constructed and arranged that top surfaces of the convex sections coincide with a part of a curved surface of a single cylinder having a shape corresponding to that of the toner carrier roller, a virtual surface which is obtained by extending the top surface of each convex section in the width direction and forms a part of the curved surface of the single cylinder being defined as a convex section extending surface of each convex section, the convex section extending surfaces overlapping each other between the convex sections belonging to the same convex section row, whereas the convex section extending surfaces are spaced apart between the convex sections belonging to mutually different convex section rows;

preparing a restriction member that includes an elastic abutting member which is made of an elastic material and has an edge part which extends in the width direction;

arranging the toner carrier roller opposed to an image carrier which carries an electrostatic latent image; and developing the electrostatic latent image carried by the image carrier with toner while restricting an amount of toner carried by the toner carrier roller by pressing the edge part into contact with the surface of the toner carrier roller, wherein a width in the circumferential direction of a restriction nip that is formed by contact of the elastic abutting member with the toner carrier roller is smaller than a spacing between two convex sections belonging to convex section rows adjacent in the circumferential direction.

* * * * *